US009085190B2

(12) United States Patent
Andres et al.

(10) Patent No.: US 9,085,190 B2
(45) Date of Patent: Jul. 21, 2015

(54) SYNTHESIS OF AUTHENTICABLE HALFTONE IMAGES WITH NON-LUMINESCENT HALFTONES ILLUMINATED BY AN ADJUSTABLE LUMINESCENT EMISSIVE LAYER

(71) Applicants: Julien Andres, Carrouge (CH); Roger D. Hersch, Epalinges (CH)

(72) Inventors: Julien Andres, Carrouge (CH); Roger D. Hersch, Epalinges (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 458 days.

(21) Appl. No.: 13/716,226

(22) Filed: Dec. 17, 2012

(65) Prior Publication Data

US 2014/0168426 A1 Jun. 19, 2014

(51) Int. Cl.

| | |
|---|---|
| ***B41M 3/14*** | (2006.01) |
| ***G07D 7/12*** | (2006.01) |
| ***G07D 7/20*** | (2006.01) |
| ***B42D 25/405*** | (2014.01) |
| ***B42D 25/29*** | (2014.01) |
| ***B42D 25/00*** | (2014.01) |

(52) U.S. Cl.

CPC ..... *B41M 3/144* (2013.01); *B41M 3/14* (2013.01); *B42D 25/00* (2014.10); *B42D 25/29* (2014.10); *B42D 25/405* (2014.10); *G07D 7/122* (2013.01); *G07D 7/205* (2013.01); *G07D 7/2058* (2013.01); *B42D 2033/04* (2013.01); *B42D 2033/06* (2013.01); *B42D 2033/20* (2013.01); *B42D 2035/26* (2013.01)

(58) Field of Classification Search

CPC B41M 3/144; B41M 7/0027; B42D 2033/00; B42D 2043/04; B42D 2033/20

See application file for complete search history.

(56) References Cited

U.S. PATENT DOCUMENTS

| | | | |
|---|---|---|---|
| 4,652,464 | A | 3/1987 | Ludlum et al. |
| 6,338,892 | B1 | 1/2002 | McCue |
| 6,400,386 | B1 | 6/2002 | No |
| 7,279,234 | B2 | 10/2007 | Dean |
| 8,085,438 | B2 | 12/2011 | Hersch et al. |
| 2010/0047488 | A1 | 2/2010 | Syrjanen et al. |
| 2010/0157377 | A1 | 6/2010 | Zhao et al. |

OTHER PUBLICATIONS

U.S. Appl. No. 12/805,872, filed Aug. 23, 2010, Hersch, Rossier et al.

(Continued)

*Primary Examiner* — Huy T Nguyen

(57) ABSTRACT

A method and computing system are proposed for producing an authenticable security device with two sides. The verso side is covered with an adjustable luminescent emissive layer formed by invisible luminescent ink halftones and possibly a UV absorbing printed layer. The recto side is covered with transmissive non-luminescent ink halftones. The backlit colors resulting from the emissions of the luminescent layer or resulting from illumination by normal white light through the transmissive non-luminescent ink halftones are predicted by a backlighting model. This model enables computing the surface coverages of the luminescent and/or non-luminescent ink halftones in order to obtain a desired color either under excitation light (UV light) or under normal white light. This enable creating authenticable backlit images substantially similar to pre-stored reference images, either under normal white light, under excitation light, or under both the normal white light and the excitation light.

25 Claims, 17 Drawing Sheets

(56) References Cited

OTHER PUBLICATIONS

R.L. van Renesse, Optical Document Security, 3rd edition, Ed. Artech House optoelectronics library, pp. 133-136.
Wyble, D. R., Berns, R. S., A Critical Review of Spectral Models Applied to Binary Color Printing. Journal of Color Research and Application vol. 25, No. 1, 2000, pp. 4-19.
R.D. Hersch, F. Crété, Improving the Yule-Nielsen modified spectral Neugebauer model by dot surface coverages depending on the ink superposition conditions, Color Imaging X: Processing, Hardcopy and Applications, Proc SPIE 5667, 2005, pp. 434-445.
R. Rossier, R.D. Hersch, Hiding patterns with daylight fluorescent inks, Proc. IS&T/SID's 19th Color Imaging Conference, Nov. 2011, pp. 223-228.
R.L. Van Renesse, Chapter 7, Interference-based security features, in Optical Document Security, 3rd edition, Artech House, pp. 223-264.
R. Rossier, R.D. Hersch, Gamut expanded halftone prints, Proc. IS&T/SID's 20th Color Imaging Conference, Nov. 2012.
Chapter 10, Digital Color Imaging Handbook, (ed. G. Sharma), CRC Press, 2003, p. 639-685, included by reference.(gamut mapping).

A

A'

B

C

B'

C'

SYNTHESIS OF AUTHENTICABLE HALFTONE IMAGES WITH NON-LUMINESCENT HALFTONES ILLUMINATED BY AN ADJUSTABLE LUMINESCENT EMISSIVE LAYER

The present invention is a continuation in part of patent application Ser. No. 13/374,823, "Synthesis of authenticable halftone images with non-luminescent halftones illuminated by a luminescent emissive layer", filed 17 Jan. 2012. The present invention is also related to U.S. Pat. No. 8,085,438 "Printing color images visible under UV light on security documents and valuable articles", filed 23 Apr. 2007 to Hersch (also inventor in present application), Donzé and Chosson, hereinafter referenced as [Hersch et al. 2007] which teaches a method for printing full color images invisible under daylight and visible under UV illumination with fluorescent inks which may have emission colors different from red, green and blue. The presently disclosed invention comprises in addition to the luminescent emissive ink halftone image on the verso side of a print also a non-luminescent transmissive halftone image on the recto side of the print. The superposition of these luminescent and non-luminescent halftone image layers enables the creation of new effects comprising intensity variations as well as color variations providing additional security for the authentication of security documents and valuable items. The present invention is also related to patent application Ser. No. 12/805,872, Synthesis of authenticable luminescent color halftone images, filed Aug. 23, 2010, inventors RD. Hersch (also inventor in present application) and R. Rossier. That invention deals exclusively with combinations of daylight luminescent inks and classical inks printed on the same side of a substrate. Daylight luminescent inks differentiate themselves from the substantially invisible luminescent inks of the present invention by the fact that they absorb light in the visible wavelength range.

BACKGROUND

The present invention relates to the field of anti-counterfeiting and authentication methods and devices and, more particularly, to methods, security devices and apparatuses for authenticating documents and valuable products by luminescent backlit full color images composed of a non-luminescent transmissive color image on one side of a transmissive substrate (recto side) and a luminescent emissive color image on the other side of the transmissive substrate (verso side).

The invented authentication method relies on a device that has a given appearance under normal white light (e.g. daylight, tungsten light, light from a fluorescent tube, etc.) and another appearance or a substantially similar appearance under an excitation light (e.g. UV light).

The present invention is related to see-through devices which also comprise front and back images that form a new image when viewed in transmission. Such devices require a high registration accuracy between front and back images. Prior art see-through devices are present on several bank notes, see book R. van Renesse, Optical Document Security, 3$^{rd}$ edition, Ed. Artech House optoelectronics library, pp. 133-136.

In U.S. patent application Ser. No. 12/519,981, "Data carrier with see-though window and method for producing it", filed Dec. 5, 2007, inventors Syrjanen et al. propose a data carrier having a see-through portion that allows revealing security features with a different appearance on each side under special lighting conditions. The see-though portion comprises security markings, a developer material and a filtering material both changing the appearance of the security markings The developer material can be luminescent inks and the filtering material UV or IR filters.

In contrast to Syrjanen's invention, the present invention aims at creating full color images visible both under normal light (e.g. daylight, tungsten light, fluorescent light, halogen light) and under an excitation light (e.g. UV light).

In U.S. patent application Ser. No. 12/337,686, "UV fluorescence encoded background images using adaptive halftoning into disjoint sets", filed Dec. 18, 2008, inventors Zhao et al. propose to create a watermark visible under UV by using UV-active and UV-dull metameric pairs.

In U.S. Pat. No. 4,652,464, "Printing fine art with fluorescent and non-fluorescent colorants", filed Aug. 5, 1985, inventors Ludlum et al. propose a method combining invisible and visible fluorescent colorants and non-fluorescent colorants for artistic purposes.

In U.S. Pat. No. 6,400,386, "Method of printing a fluorescent image superimposed on a color image", filed Apr. 12, 2000, inventor No proposes a method for enhancing the visibility of an image in the dark by printing with phosphorescent inks the outline of an original image printed with classical cyan, magenta and yellow inks.

In U.S. patent application Ser. No. 11/666,029, "Color reproduction on translucent or transparent media", filed Oct. 28, 2004, inventors Perez and Lammens show how to generate a device color profile on translucent or transparent media. They combine reflected and transmitted colors to build lookup tables and profiles for printing. No color prediction model is used.

A further related field is backlit displays for advertising purposes. Such devices use a backlight source illuminating a transmissive color image to achieve bright images that can be seen in the dark, for example in outdoors advertisement. U.S. Pat. No. 6,338,892, "Imageable backlit composite structure", filed Oct. 13, 1999, inventors McCue et al. claim an image on one side and a light emitting layer formed by phosphorescent or fluorescent materials on the other side. Variations of the light emitting layer for creating authentication elements are not mentioned. No variable intensity or variable color image is formed by the light emitting layer.

In contrast to these prior art inventions, we reproduce, by applying a color prediction model, a luminescent emissive variable intensity or variable color image on one side and a non-luminescent transmissive color halftone image on the other side to obtain a luminescent backlit image formed by the transmission of the luminescent emissive image through the non-luminescent transmissive color halftone image. The verso luminescent emissive image, the recto non-luminescent transmissive image as well as the luminescent backlit image are used for authentication purposes.

SUMMARY

The presents invention aims at creating authenticable images with a security device having on one the verso side a substantially invisible luminescent emissive layer, possibly superposed with a UV-absorbing variable intensity layer, and, superposed on the recto side, a non-luminescent transmissive halftone layer, with a separating transmissive layer located between the superposed luminescent layer and the non-luminescent transmissive layer. A backlit image is the image that can be observed on the recto side when illuminating the verso side either with normal white light or with excitation light such as UV light inducing the emission of the luminescent emissive layer. When illuminated by excitation light, the backlit luminescent image results from the emission of the excited luminescent halftone layer transmitted through the absorbing non-luminescent halftone layer. When illuminated by normal white light from the verso side, the backlit non-luminescent image observable on the recto side is formed by the transmittance of the absorbing non-luminescent halftone layer. For authentication purpose, both the backlit luminescent and the backlit non-luminescent image can be viewed by a human being or captured by a computerized multi-channel sensor system and compared with corresponding known reference images. If the viewed or acquired images are substantially similar to the corresponding reference images, the valuable item incorporating the security device is considered to be authentic. As further authentication means, the security device can be illuminated and viewed or captured by a sensor from the same side. As an example, the security device is illuminated from the verso side with an excitation light source and the direct luminescent image emitted from the luminescent emissive halftone layer is viewed or captured from the same verso side and compared with a reference image. As a further example, the security device is illuminated from the recto side with a normal white light source and the image reflected from the non-luminescent halftone layer is viewed or captured from the same recto side and compared with a reference image.

In addition, the possible presence of a UV absorbing layer printed on the verso side in superposition with the emissive layer contributes to an additional attenuation of the emission of the luminescent layer and therefore offers even more possibilities of producing backlit images.

The fact that the backlit images are formed by superposed luminescent emissive and non-luminescent partly absorbing transmissive layers enables creating secure devices which are very difficult to counterfeit, since a potential counterfeiter would have to correctly reproduce both layers, whose individual intensities or colors are unknown to him.

One may for example create within the non-luminescent transmissive layer a reduced intensity raised color halftone image, viewable under normal white light as backlit color image substantially similar to a first reference color image. The corresponding luminescent emission ink halftone layer is conceived to form the negative image of the reduced intensity raised color halftone image and to possibly incorporate as further attenuation a second intensity reduced color image. Under excitation light from the verso side, the backlit luminescent image then appears gray if the luminescent emission ink halftone layer forms the negative image of the reduced intensity raised color halftone image. It appears as a second intensity reduced color image if the luminescent emission ink halftone layer forms the negative image of the reduced intensity raised color halftone image and is further attenuated by the second intensity reduced color image. The security device can then be authenticated by comparing (a) the normal light backlit non-luminescent color image with the first reference image and (b) the excitation light luminescent backlit color image with the reference second intensity reduced color image.

One may also embed either within the luminescent emissive halftone layer or within the non-luminescent ink halftone layer a message, which is hidden by compensation by the other layer so as to prevent its appearance in the backlit luminescent image, when illuminated under the excitation light source. However under the normal white light source, in both cases, the message appears. The simultaneous presence and absence of the message when switching from normal white light to excitation light clearly indicates that the valuable item incorporating the security device is authentic.

The fact that the backlit images are formed by superposed luminescent emissive and non-luminescent absorbing layers enables creating secure devices which are very difficult to counterfeit, since a potential counterfeiter would have to correctly reproduce both layers, whose individual intensities or colors are unknown to him.

In order to synthesize both the luminescent emissive halftone layer and the non-luminescent halftone layer, one needs a software running on a computer with modules capable of performing (a) the prediction of both luminescent emissive and transmissive absorbing colors as a function of ink surface coverages, in emission mode, in transmittance mode and in reflectance mode, (b) the mapping of an input gamut into an output gamut formed by the emission spectra of the luminescent layer ink halftones, possibly attenuated by the UV-absorbing ink halftones, and further attenuated by the transmittances of the non-luminescent ink halftone layer and (c) the mapping of an input gamut into an output gamut formed by normal white light attenuated by the transmittances or reflectances of the non-luminescent transmissive ink halftone layer.

DESCRIPTION OF THE INVENTION

Figure 1:
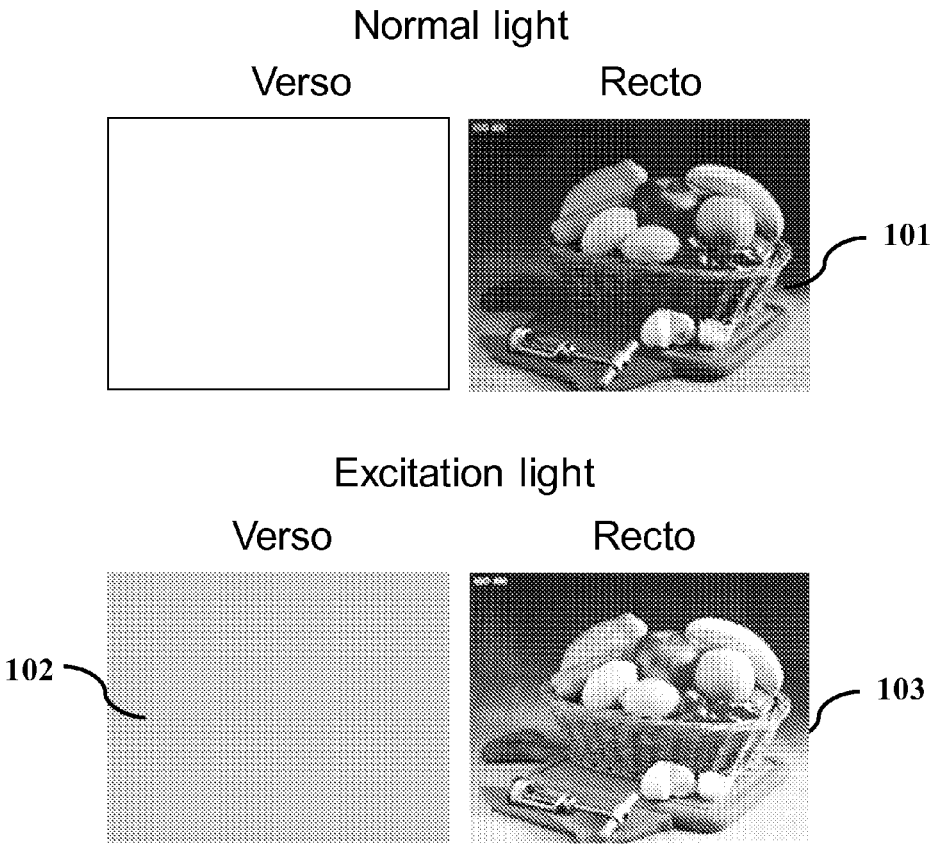
FIG. 1 shows the transparent verso and the non-luminescent transmissive color image 101 of the recto of a security device under normal light and, under excitation light, on the verso, the emission color of the luminescent emission layer 102 and on the recto the appearing backlit color image 103 formed by the emission of the luminescent layer 102 attenuated by the non-luminescent transmissive color image 101.

The present invention aims at creating a security element relying on authenticable full color images whose appearance differs when viewed under normal light from the appearance viewed under an excitation light source such as UV light. The change in color appearance is due to the emission of a substantially invisible luminescent layer image located on the verso side and illuminating, under the excitation light, a non-luminescent transmissive color image located on the recto side. The revealed backlit image on the recto side is formed by the emission of the luminescent layer on the verso side transmitted through the non-luminescent transmissive image on the recto side and is called "luminescent backlit image". The observable image on the verso side formed by the emission of the luminescent emissive layer also located on the verso side is called "direct luminescent emissive image". The non-luminescent transmissive image is either directly printed on a diffusing substrate such as paper or printed on a transparency that is fixed onto a transmissive diffusing substrate. The non-luminescent transmissive image reflected on the diffusing substrate is called "reflected non-luminescent transmissive image".

Luminescence is defined as the emission of light from a material due to an excitation. Photoluminescence is a special case of luminescence where the excitation source is a distinct light source. Ultra-Violet (UV) light or Infra-Red (IR) light are two different excitation light sources which are commonly used to obtain a visible photoluminescence, i.e. a light emission in the visible region of the spectrum, between the UV and IR regions.

Normal light is defined as light with visible wavelength components, i.e. wavelengths between 380 nm and 730 nm. Examples of normal light sources include daylight, tungsten lights, halogen lights, fluorescent lights, and light emitting diodes (LED). Examples of standardized normal light illuminants are A, D75, D65, D55, D50, F1 to F12, and E illuminants.

The invention includes parts which are produced with classical non-luminescent inks, parts which are produced with luminescent emissive inks, and possibly parts that are produced with UV-absorbing non-luminescent inks. The parts produced with classical non-luminescent color inks only are called "non-luminescent transmissive halftones" and form a "non-luminescent transmissive image". The parts produced with luminescent emissive inks or with emissive materials at different concentrations or thicknesses create a luminescent emissive halftone layer or luminescent emissive variable intensity layer. The parts produced with UV-absorbing non-luminescent inks are called "UV-absorbing non-luminescent halftones" or "UV-absorbing halftones". These UV absorbing halftones adjust the intensity of the luminescent emissive halftone layer. Furthermore, the UV-absorbing halftones can form a black and white or a color image on the verso side of the substrate under normal light, which is called "UV-absorbing non-luminescent image". This UV absorbing non-luminescent image located on the verso side may represent a modified instance of the non-luminescent transmissive image located on the recto side, e.g. a black-white halftone representation of the original color image from which the non-luminescent transmissive image is derived.

The comparison between the luminescent backlit image and a known image enables authentication of the valuable item. The comparison of the color image formed by the transmitted and/or reflected non-luminescent transmissive halftones under normal light with a known image also enables its authentication. Furthermore, the direct luminescent emissive image formed by the emission of the luminescent layer viewed under an excitation light source (e.g. a UV light source) can also be compared with a known image and provides means for authentication. If present, a UV-absorbing non-luminescent image can also be compared with a known image and therefore enables authenticating the valuable item. The different authenticable color images that can be produced according to the present invention are characterized by their "authentication intent".

A simple example of such an authentication intent is the case of a luminescent emissive surface (FIG. 1, 102) of known emission color superposed with a non-luminescent transmissive image (101), that, under excitation light, yields a third image similar to the non-luminescent transmissive image, but with different colors (103), i.e. colors that appear similar to the ones of an original reference image. Such a resulting image is defined as "luminescent backlit color image". In the present authentication intent, the luminescent backlit color image appears accurate, i.e. it is similar to the original reference image. The luminescent surface can be made of luminescent emissive materials, or can be a luminescent or non-luminescent substrate printed with a luminescent emissive ink, with several luminescent emissive inks forming a luminescent emissive halftone color, which possibly is attenuated by one or several UV-absorbing non-luminescent inks.

The non-luminescent transmissive image is printed on a transmissive substrate. A transmissive substrate is a transparent, semitransparent or translucent substrate. Examples of fully or partially transmissive substrates comprise Plexiglas sheets, paper such as office paper, paper incorporating optical brighteners, paper without optical brighteners such as the Biotop paper, tracing paper, security paper, etc.

Let us define the recto side of a substrate, product or document as the side facing the observer under normal viewing conditions, and the verso side as the other side, which is illuminated by the light source, either a normal light source or an excitation light source (e.g. UV light). However other setups are possible, for example when the recto side is illuminated by the light source or when the recto and verso sides are inversed.

The invention relies on (a) a transmissive substrate, (b) a luminescent emissive layer located on the verso side of the transmissive substrate, (c) a UV-absorbing non-luminescent image printed on top of the luminescent emissive layer, (d) a non-luminescent transmissive image located on the recto side of the transmissive substrate, (e) a luminescent emission prediction model for predicting the luminescent emission spectra or colors of the luminescent emissive layer, (f) a luminescence attenuation prediction model for predicting the attenuation of the emission of the luminescent layer depending on the UV-absorbing non-luminescent image printed on top of the luminescent layer, (g) a transmittance prediction model for predicting the transmittance or transmitted colors of the non-luminescent transmissive image printed on a transmissive substrate, (h) a reflectance prediction model for predicting the reflectance or reflected colors of the non-luminescent transmissive image printed on a diffusing transmissive substrate, (i) a backlighting model for predicting the spectra or colors of the luminescent backlit image, (j) a conversion of spectral stimuli into CIE-XYZ tri-stimulus values and then into CIELAB colors, (k) gamut mapping of an input gamut into a selected output gamut, (l) color separation and calculation of the non-luminescent ink surface coverages, (m) color separation and calculation of the non-luminescent ink surface coverages and the UV-absorbing non-luminescent ink surface coverages, (n) backlit color halftone image generation and printing with a selected set of luminescent tones, and color halftone luminescent backlit image generation and printing by joint color separation and halftoning of the non-luminescent transmissive image and the luminescent color image (Application II). These elements are detailed in the text that follows.

(a) Transmissive Substrates

The transmissive substrates considered in the present invention transmit normal light fully or partly. A normal light source hitting the verso side of such substrates can be seen on their recto side and vice versa. Purely transparent substrates have very low light diffusion properties. In the case of semi-transparent and translucent substrates, diffusion of light occurs and part of the light is absorbed. A transmissive substrate can also be luminescent as described in section (b).

Examples of transmissive substrates include papers capable of transmitting part of the incident light such as office papers, high-quality papers, security papers and tracing papers. They also include various plastics and polymers, e.g. polycarbonate, polyesters, cellulose acetate (CA), styrenics, polyethylene (PET) and polypropylene.

(b) Luminescent Emissive Layer

The luminescent emissive layer comprises areas incorporating luminescent material or luminescent inks. It is located on one side of the transmissive substrate. The luminescent emissive layer can also be made of several areas of different luminescent emissive colors. The luminescent emissive layer can be a full color luminescent emissive image. The luminescent emissive layer can also be a constant uniform emissive color.

The luminescent emissive layer can be made of a luminescent emissive material, of printed luminescent emissive inks, of a luminescent emissive coating or of combinations of the previous elements. The luminescent emissive layer is formed by at least one emissive substance such as a printed luminescent emissive ink.

Luminescent emissive inks are inks made of luminescent emissive dyes and/or pigments preferably invisible under daylight. Part of their energy absorbed in the excitation wavelength range is reemitted in the visible wavelength range. The amplitude of the spectral radiant emittance or emission spectrum $E(\lambda)$ emitted by the luminescent emissive material, luminescent emissive ink or luminescent emissive ink halftones depends on the amplitude and the spectral power distribution of the incident excitation light source $I_0(\lambda)$ in the excitation wavelength range. For most luminescent emissive single component inks, varying the spectral distribution $I_0(\lambda)$ of the incident light in the excitation wavelength range only modifies the amplitude of their emission spectra $E(\lambda)$ and not their spectral distribution. In the case of invisible UV-luminescent inks, their excitation wavelength range is within the ultra-violet wavelength range. The emission colors depend on the spectral radiant emittances of the invisible luminescent emissive inks or emissive ink halftones.

In the case of three luminescent emissive inks, such as blue, red, and yellow, the superposition of the 3 emissive ink halftone layers yields halftones with colorants comprising the paper black ($u_k^e$) each emissive ink color and each emissive ink superposition color. In the present case, the colorants are black ($u_k^e$), emissive blue ($u_b^e$), emissive red ($u_r^e$), emissive yellow ($u_y^e$), emissive magenta ($u_m^e=u_r^e$ & $u_b^e$), emissive greenish blue ($u_g^e=u_b^e$ & $u_y^e$), emissive orange ($u_o^e=u_r^e$ & $u_y^e$), and emissive white ($u_w^e=u_r^e$ & $u_y^e$ & $u_b^e$), where the "&" sign indicates the superposition operation. Therefore, the superposition variants of 3 emissive inks yield the 8 emissive colorants. The Demichel equations given in formula (1) are also valid here for the luminescent emissive ink halftones. Symbolically, we express the surface coverages of the luminescent emissive colorants $a_i$ as a function of the surface coverages of the luminescent emissive inks $u_1^e$, $u_2^e$, $u_3^e$, by $a_i=D_i(u_1^e, u_2^e, u_3^e)=D_i(u_I)$, where the symbol D( ) represents a Demichel function as expressed in formula (1), where index i runs from 1 to the number of colorants, and where $u_I$ represents the surface coverages of the contributing luminescent inks, e.g. $u_1^e$, $u_2^e$, $u_3^e$ for three luminescent emissive inks.

Luminescent substrates such as paper with optical brighteners can be assimilated to substrates incorporating a luminescent emissive layer. Most white papers are composed of fluorescent optical brighteners and exhibit a strong blue fluorescent emission under UV light. Polymeric materials can also incorporate luminescent materials (e.g. PMMA, polymethylmethacrylate), see for example U.S. Pat. No. 7,279,234, "Methods for identity verification using transparent luminescent polymers", filed Aug. 18, 2004 issued Oct. 9, 2007, priority Aug. 12, 2003, inventor Dean.

(c) UV-Absorbing Non-Luminescent Image

UV-absorbing non-luminescent inks are inks that absorb in the UV excitation light wavelength range but that are non-luminescent. UV-absorbing non-luminescent inks can be used to adjust the amount of UV excitation light reaching the luminescent emissive layer, and hence to modify the luminescent emission intensity of the luminescent emissive layer under UV excitation light. UV-absorbing non-luminescent ink halftones can be printed on the verso side of the transmissive substrate on top of the luminescent emissive layer. If the UV-absorbing non-luminescent ink halftones also absorb light in the visible wavelength range, then, UV-absorbing non-luminescent halftones form UV-absorbing non-luminescent images that are visible under normal light. If the UV-absorbing inks are invisible, UV-absorbing non-luminescent halftones form UV-absorbing non-luminescent images only under excitation light by attenuation of the luminescent emissive layer. As an example, a UV-absorbing non-luminescent black ink can be used as a UV-absorbing non-luminescent ink. The UV-absorbing non-luminescent black ink halftone printed on top of the luminescent emissive layer forms a grayscale UV-absorbing halftone image that can be observed under normal light. Under UV excitation light, the UV-absorbing non-luminescent black halftones locally attenuate the intensity of the UV-excitation light and therefore yield an attenuated luminescent emissive layer. Instead of, or in addition to the UV-absorbing non-luminescent black ink, one can use UV-absorbing non-luminescent cyan, magenta and yellow inks or other chromatic or achromatic UV absorbing inks.

(d) Non-Luminescent Transmissive Image

The non-luminescent transmissive image is a multichromatic image obtained by printing with non-luminescent inks on a transmissive substrate. Non-luminescent inks are made of non-luminescent dyes and/or pigments. The light absorption occurs at least partly in the visible range. Classical cyan, magenta and yellow inks are examples of light absorbing non-luminescent inks.

As is known in the art, color halftones may be formed by mutually rotated layers of clustered ink dots. They may also be formed by stochastic dots, generated with a blue noise dither matrix, or by error-diffusion.

In the case of three classical non-luminescent inks, such as cyan (c), magenta (m) and yellow (y), the superposition of the 3 ink halftone layers yields halftones with colorants comprising the paper white (w), each ink color and colors resulting from the superposition of inks. In the present case, the colorants are white (w), cyan (c), magenta (m), yellow (y), red (r=m & y), green (g=c & y), blue (b=m & c), and chromatic black (k=c & m & y), where the "&" sign indicates the superposition operation. Therefore, all superposition variants of 3 inks yield 8 colorants and of 4 inks yield 16 colorants.

When printing the ink layers independently of one another, for example with mutually rotated layers, with blue noise dithering, or with error diffusion, the surface coverages of the colorants $a_1$ to $a_8$ representing the paper, the single inks and the superpositions of two or three inks can be expressed as functions of the surface coverages of the inks $u_1$, $u_2$, $u_3$, as follows:

$$a_1=(1-u_1)(1-u_2)(1-u_3);\ a_2=u_1(1-u_2)(1-u_3);\ a_3=(1-u_1)u_2(1-u_3);$$

$$a_4=(1-u_1)(1-u_2)u_3;\ a_5=u_1u_2(1-u_3);\ a_6=u_1(1-u_2)u_3;$$

$$a_7=(1-u_1)u_2u_3;\ a_8=u_1u_2u_3; \quad (1)$$

Equations (1) are known as the Demichel equations and are also valid in the case that the inks are luminescent inks They can be extended to 4 or more inks, see Wyble, D. R., Berns, R. S., A Critical Review of Spectral Models Applied to Binary Color Printing. Journal of Color Research and Application Vol. 25, No. 1, 2000, pp. 4-19, incorporated by reference.

Hereinafter, the surface coverages of the colorants are called $a_j$, where the index j runs from 1 to the number of colorants. Note that the surface coverages of the colorants sum to one, i.e.

$$\sum_j a_j = 1.$$

Symbolically, we express the surface coverages of the non-luminescent colorants $a_j$ as a function of the surface coverages of the non-luminescent inks $u_1$, $u_2$, $u_3$, by $a_j=D_j(u_1, u_2, u_3)=D_j(u_J)$, where the symbol D( ) represent a Demichel function expressed in formula (1), where index j runs from 1 to the number of non-luminescent colorants, and where $u_J$ represents the surface coverages of the contributing non-luminescent ink, i.e. $u_1$, $u_2$, $u_3$.

(e) Luminescent Emission Prediction Model for Predicting the Luminescent Emission Spectra E(λ) or Colors of the Luminescent Emissive Layer If the luminescent emissive layer is printed with luminescent emissive inks, a model for predicting the emission spectra or colors of the luminescent emissive halftones is used. The goal of a color emission prediction model is to establish a mapping between ink surface coverages of a selected set of luminescent emissive inks and the resulting emitted colors. With such a mapping, one can find the inverse mapping, i.e. the mapping between the desired emitted color and ink surface coverages of the considered set of luminescent emissive inks that have to be printed to obtain this desired emitted color.

As an alternative to a color emission prediction model, one may directly establish a mapping between the desired luminescent emissive color and surface coverages of the luminescent emissive inks by printing samples with combinations of all selected luminescent emissive inks at variations of surface coverages e.g. surface coverages of [0, 0.05, 0.10, . . . 0.95, 1]. This yields 21 samples per ink, i.e., for a luminescent set of 3 inks, 9261 samples. Each sample is measured by a spectrophotometer under the excitation light source. The measured emittance (emission spectrum) is converted to a color value. One may then interpolate between these color values to create the mapping between desired color and surface coverages of the inks, see R. Bala, Chapter 5, Device Characterization, Section 5.4.5. Lattice-based interpolation, in Digital Color Imaging Handbook, (Ed. G. Sharma), pp. 301-304.

The Yule-Nielsen modified Spectral Neugebauer prediction model (hereinafter: YNSN) adapted to the spectral radiant emittance specifies the possibly non-linear relationship between the emittance $E(\lambda)$ of a luminescent emissive color halftone, the emittances of the individual solid emissive colorants $E_i(\lambda)$ and their surface coverages $a_i$ by a power function whose exponent n can be optimized according to the emittance of a limited set of luminescent color halftone patches, see related U.S. patent application Ser. No. 11/785,931 [Hersch et. al. 2007].

$$E(\lambda) = \left(\sum_i a_i \cdot E_i(\lambda)^{\frac{1}{n}}\right)^n \tag{2}$$

In order to make accurate spectral or color predictions, the YNSN model needs to be extended, for example by combining it with an ink spreading model, see the following publication about the ink-spreading enhanced YNSN model, incorporated by reference: R. D. Hersch, F. Crété, Improving the Yule-Nielsen modified spectral Neugebauer model by dot surface coverages depending on the ink superposition conditions, Color Imaging X: Processing, Hardcopy and Applications, Proc SPIE 5667, 2005, pp. 434-445, hereinafter referenced as [Hersch 2005].

The spectral radiant emittance described by equation (2) can be converted into a CIE-XYZ tri-stimulus value according to equations (11) and then into a CIELAB color, see section (j).

(f) Luminescence Attenuation Prediction Model for Predicting Attenuations of the Luminescent Layer Emission Resulting from UV-Absorbing Non-Luminescent Halftones Printed on Top of it When UV-absorbing non-luminescent halftones are printed on top of the luminescent emissive layer, the emission of the luminescent layer is modified according to the surface coverage of the UV-absorbing non-luminescent inks. An attenuation factor can model the attenuation. This attenuation factor can be a spectral attenuation factor that depends on the wavelengths of the luminescent layer emission, or simply a scaling factor. The attenuation factor $K(\lambda)$ attenuates the emission spectrum of the unattenuated luminescent emissive layer $E_0(\lambda)$ to yield the emission spectrum $E(\lambda)$ used as backlight for non-luminescent transmissive halftones in (7):

$$E(\lambda)=K(\lambda)\cdot E_0(\lambda) \tag{3}$$

The attenuation factor $K(\lambda)$ can be calculated by a spectral prediction model. For example, the attenuation factor can be calculated from the attenuation of the luminescent emissive layer by the UV-absorbing non-luminescent colorants $K_p(\lambda)$, in a similar manner as the YNSN model adapted to transmittances defined in (g).

Alternatively, the attenuation factor can be modeled by raising the attenuation factor of the UV-absorbing non-luminescent colorants $K_p(\lambda)$ with their effective surface coverages $a_p$ and multiplying the attenuation factors of each UV-absorbing non-luminescent colorant:

$$K(\lambda) = \prod_p K_p(\lambda)^{a_p} \tag{4}$$

The effective surface coverages $a_p$ are deduced from the effective surface coverages of the UV-absorbing non-luminescent inks by using ink spreading equations and the Demichel equations (1). The index p is the index of the UV-absorbing non-luminescent colorants. The calculation of the attenuation factor and the calculation of the resulting attenuated emission spectrum define an emission attenuation prediction model.

(g) A Transmittance Prediction Model for Predicting the Transmittances or Transmitted Colors of a Non-Luminescent Transmissive Image (Transmittance Mode)

A variation of the ink spreading enhanced YNSN model enables predicting the transmittances or transmitted colors of non-luminescent transmissive halftones printed with a set of non-luminescent inks on a transmissive substrate.

The YNSN model adapted to the transmission mode specifies the non-linear relationship between the transmittance $T(\lambda)$ of a non-luminescent transmissive color halftone, the transmittances of individual solid colorants $T_j(\lambda)$ and their surface coverages $a_j$ by a power function whose exponent m can be optimized according to the transmittance of a limited set of non-luminescent color halftone patches.

$$T(\lambda) = \left(\sum_j a_j \cdot T_j(\lambda)^{\frac{1}{m}}\right)^m \tag{5}$$

In order to make accurate spectral or color predictions, the YNSN model needs to be extended, for example by combining it with an ink spreading model, see [Hersch 2005].

When illuminated from the verso side, the observer facing the recto side of the transmissive substrate will see colors by transmission of the light through the non-luminescent transmissive halftone image printed on the recto side of the transmissive substrate. In that case, the stimulus transmitted by the non-luminescent transmissive halftone image can be converted into a CIE-XYZ tri-stimulus value according to equations (11) and then into a CIELAB color, see section (j).

If the transmissive substrate is sufficiently diffusing (as in paper substrates) and illuminated from the recto side, the reflected stimulus can be predicted with a reflectance prediction model, see section (h), converted into a CIE-XYZ tri-stimulus value according to equation (11) and then into a CIELAB color, see section (j). Both the transmitted color halftone image and the reflected color halftone image can be used for document authentication by comparing them with known images.

(h) A Reflectance Prediction Model for Predicting the Reflectance or Reflected Colors of the Non-Luminescent Transmissive Image Printed on a Diffusing Transmissive Substrate (Reflective Mode)

Reflectance can be predicted by a variant of the YNSN model that specifies the non-linear relationship between the reflectance $R(\lambda)$ of a non-luminescent color halftone, the reflectance of individual solid colorants $R_j(\lambda)$ and their surface coverages $a_j$ by a power function whose exponent u can be optimized according to the reflectance of a limited set of non-luminescent color halftone patches.

$$R(\lambda) = \left(\sum_j a_j \cdot R_j(\lambda)^{\frac{1}{u}}\right)^u \quad (6)$$

In order to make accurate spectral or color predictions, the YNSN model needs to be extended, for example by combining it with an ink spreading model, see [Hersch 2005].

When illuminated from the recto side, the stimulus reflected by the non-luminescent transmissive halftone image can be converted into a CIE-XYZ tri-stimulus value according to equation (11) and then into a CIELAB color, see section (j).

Figure 2:
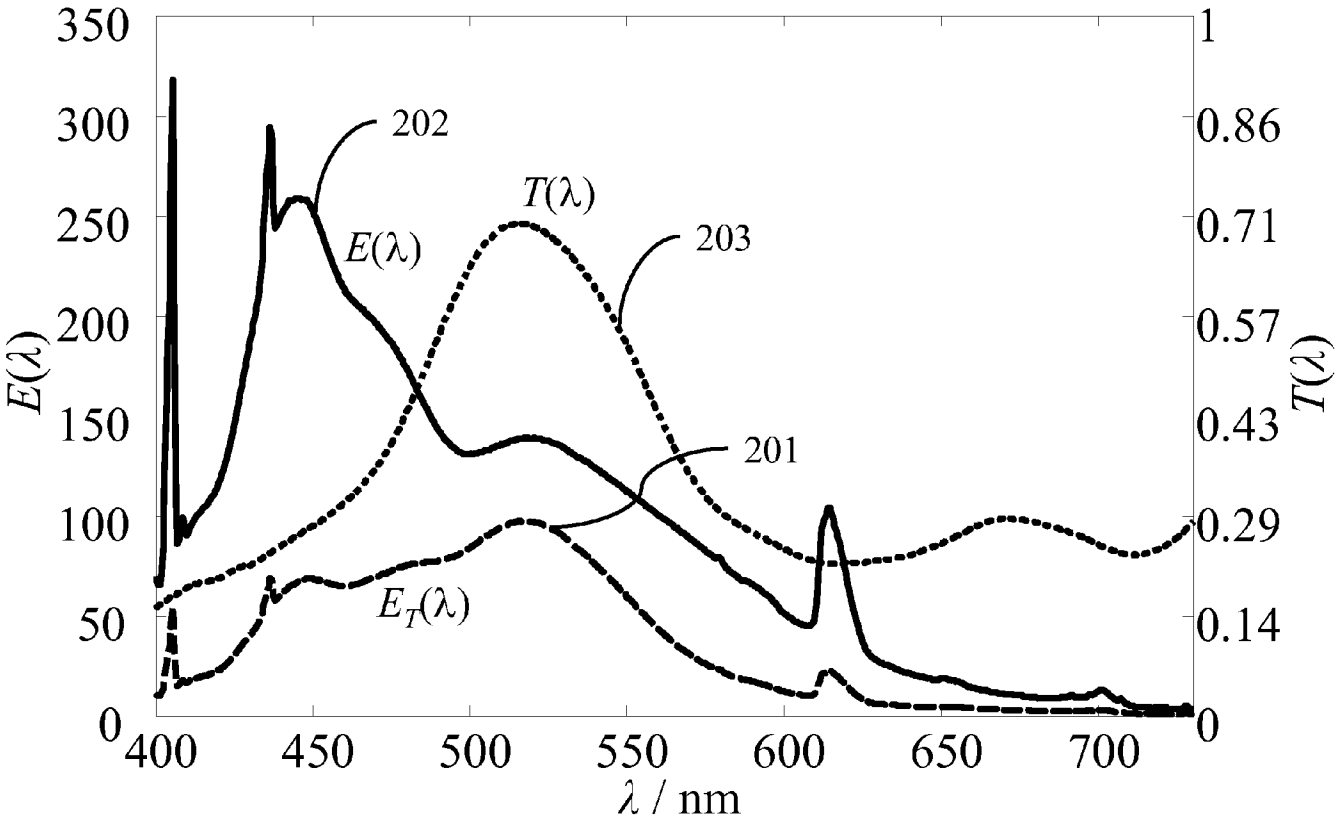
FIG. 2 shows the luminescent backlit spectrum $E_T(\lambda)$ resulting from the attenuation of the luminescent emission spectrum $E(\lambda)$ by the transmittance $T(\lambda)$ of the non-luminescent transmissive halftone image.

(i) A Backlighting Model for Predicting the Luminescent Backlit Spectra or Colors of Luminescent Emissions from the Luminescent Emissive Layer Through a Non-Luminescent Transmissive Halftone Image The luminescent backlit spectra $E_T(\lambda)$ (see FIG. 2, 201) resulting from the attenuation of the emission spectra by the transmittances of the non-luminescent transmissive halftone image are modeled as the product of the emission spectrum $E(\lambda)$ (202) of the luminescent emissive layer with the transmittance $T(\lambda)$ (203) of the non-luminescent transmissive halftone image printed on the transmissive substrate:

$$E_T(\lambda)=E(\lambda)\cdot T(\lambda) \quad (7)$$

The transmittances are predicted using the transmittance prediction models proposed in (g). If the luminescent emissive layer is spatially constant, its emission spectrum $E_{lum}(\lambda)$ can be measured once to calibrate the model. In this case, the luminescent backlit spectra $E_T(\lambda)$ are expressed by equation (8), by expressing the transmittance of the non-luminescent transmissive halftone located on the recto side of the transmissive substrate as a function of the surface coverages of the non-luminescent colorants forming that transmissive halftone $$E_T(\lambda) = E_{lum}(\lambda)\cdot\left(\sum_j a_j \cdot T_j(\lambda)^{\frac{1}{m}}\right)^m \quad (8)$$

In case of the presence of a UV-absorbing non-luminescent ink halftone layer, we obtain according to Eqs. (3) and (4):

$$E_T(\lambda) = E_{lum}(\lambda)\left(\prod_p K_p(\lambda)^{a_p}\right)\cdot\left(\sum_j a_j \cdot T_j(\lambda)^{\frac{1}{m}}\right)^m \quad (9)$$

The emission attenuation by the UV-absorbing ink halftone layer $K(\lambda)$, see Eq. (4), further attenuates the emitted light, in addition to the attenuation performed by the non-luminescent transmissive halftones. The color gamut obtained with the UV-absorbing non-luminescent ink halftones (FIG. 3B, 311) is significantly larger than the gamut (310) without UV-absorbing non-luminescent ink halftones, especially in the dark tones.

In one embodiment of the present invention, the luminescent emissive layer colors are limited to a few "luminescent tones". A white, grayish, reddish, greenish and bluish white can for example be chosen as "luminescent tone" $E_{lum}(\lambda)$. Each of these five luminescent tones acts as a light source, possibly attenuated by the UV absorbing ink halftone, traversing the non-luminescent transmissive halftones. The luminescent backlit spectra of the emissions from these luminescent tones, $E_{lum}(\lambda)$, traversing the non-luminescent transmissive halftones are expressed by equation (8) and in case of an attenuating UV absorbing layer by Eq. (9).

In another embodiment, the luminescent emissive layer forms a color image with location dependent variable emission spectra. The emission spectra of the luminescent image are predicted with the luminescent emission prediction model proposed in section (e). The luminescent backlit spectra $E_T(\lambda)$ are then predicted according to equation (10). The first part on the right side of equation (10) is the same as in equation (2) and the second part of equation (10) is the same as in equation (5).

$$E_T(\lambda) = \left(\sum_i a_i \cdot E_i(\lambda)^{\frac{1}{n}}\right)^n \cdot \left(\sum_j a_j \cdot T_j(\lambda)^{\frac{1}{m}}\right)^m \quad (10)$$

Luminescent backlit spectra $E_T(\lambda)$ can be converted into CIE-XYZ tri-stimulus values and then into CIELAB colors according to section (j).

(j) Conversion of Spectral Stimuli into CIE-XYZ Tri-Stimulus Values and then into CIELAB Colors The spectral stimuli $S(\lambda)$ formed by the luminescent emissions predicted in section (e), a normal light illuminant attenuated by the transmittances predicted in section (g), a normal light illuminant attenuated by the reflectances predicted in section (h) as well as the luminescent backlit spectra predicted in section (i) can be converted into a color space to predict the corresponding colors that can be reproduced with a set of luminescent emissive inks forming the luminescent emissive layer, non-luminescent inks forming the non-luminescent transmissive image and the superposition of the two forming the luminescent backlit image.

The preferred color space is CIELAB. The L*a*b* values are calculated from the CIE-XYZ tri-stimulus values by providing a reference ($X_W$, $Y_W$, $Z_W$) coordinate that defines the white point of the color space. The conversion of a spectral stimulus to tri-stimulus CIE-XYZ colorimetric values is carried out according to equations (11), well known in the art. In the present case, we define the normalization factor K with a selected "white" reference stimulus $S_{ref}(\lambda)$. In the case of stimuli resulting from normal light attenuated by transmittance or reflectance, the reference stimulus $S_{ref}(\lambda)$ is the normal light illuminant (e.g. standard normal light illuminant such as D65, D50, E, or one of the F illuminants) attenuated by the reference non-luminescent unprinted transmissive or respectively reflective substrate. In the case of emission spectra $E(\lambda)$ or of luminescent backlit spectra $E_T(\lambda)$, their spectral radiant emittances across the unprinted transmissive substrate are directly used as stimuli. The corresponding reference stimulus $S_{ref}(\lambda)$ is then a selected reference emittance $E_{ref}(\lambda)$ representing the "whitest" emitted spectrum emerging from the unprinted transmissive substrate. According to equations (11), this reference stimulus $S_{ref}(\lambda)$ then yields a Y value of 100.

$$X = K\cdot\int_\lambda S(\lambda)\cdot\bar{x}(\lambda)\cdot d\lambda \quad (11)$$

$$Y = K\cdot\int_\lambda S(\lambda)\cdot\bar{y}(\lambda)\cdot d\lambda$$

$$Z = K\cdot\int_\lambda S(\lambda)\cdot\bar{z}(\lambda)\cdot d\lambda$$

-continued $$K = \frac{100}{\int_{\lambda} S_{ref}(\lambda) \cdot \bar{y}(\lambda) \cdot d\lambda}$$

As is known in the art, when calculating X, Y, Z values, the integrals of equations (11) are replaced by summations of discrete spectral components weighted by the discrete color matching functions over the visible wavelength range.

When converting from the CIE-XYZ color space to the CIELAB color space, a white adaptation reference needs to be defined. For example, in the case of luminescent emissive red, yellow-green and blue inks, the emission spectrum of the white colorant printed on the verso side of the transmissive substrate by the superpositions of the luminescent emissive red, yellow-green and blue inks and emerging from the recto side is converted to CIELAB and becomes the white adaptation reference for emissive inks in transmittance mode. Under normal light illumination, the CIELAB white adaptation reference is usually the normal light attenuated by the transmittance or respectively the reflectance of the unprinted transmissive substrate.

(k) Gamut Mapping of an Input Gamut into a Selected Output Gamut

In the present invention, we consider two illuminations, a normal white light illumination yielding the non-luminescent backlit image and illumination by the luminescent emissive layer under excitation light yielding the luminescent backlit image. Under normal light illumination, the non-luminescent transmissive image is formed either by transmission or reflection of the normal light source. The colors achievable under normal light transmission or reflection through or respectively on the transmissive non-luminescent color image form two different gamuts. The colors formed by transmission of the normal light illumination through the non-luminescent transmissive color image form the normal light transmitted gamut. The colors formed by reflection of the normal light illumination on the non-luminescent transmissive color image form the normal light reflected gamut. In case of a UV absorbing ink halftone layer which further attenuates the incident normal light, the resulting normal light transmitted gamut is larger and incorporates also dark colors.

Under an excitation light, (e.g. a UV light source), the luminescent backlit image colors can be predicted as explained in section (i). If the luminescent layer is composed of many different luminescent emissions achievable by different surface coverages of the luminescent emissive inks, each emission spectrum may be transmitted through each non-luminescent transmissive halftone. Therefore, each different luminescent emission traversing the non-luminescent transmissive halftones yields a specific gamut, hereinafter "specific luminescent backlit sub-gamut". These sub-gamuts form the boundary of a larger gamut representing all reproducible colors with all the different specific luminescent emissions traversing all possible non-luminescent transmissive halftones. The larger gamut is the "merged luminescent backlit gamut" achievable by all considered variations of specific luminescent emissions through the non-luminescent transmissive halftones. The range of colors inside each specific luminescent backlit sub-gamut depends on the corresponding specific luminescent emission spectrum. With a UV absorbing non-luminescent halftone ink layer, larger luminescent backlit sub-gamuts can be achieved, as well as a larger merged luminescent backlit gamut comprising also dark and very dark tones.

As an example, if five luminescent tones are selected, five specific luminescent backlit sub-gamuts are formed by the five luminescent tones. A luminescent backlit spectrum produced by a specific luminescent tone transmitted through a non-luminescent transmissive halftone belongs to the specific luminescent backlit sub-gamut associated with that specific luminescent tone. The union of these five sub-gamuts forms a merged luminescent backlit gamut whose boundary encloses all colors reproducible by selecting for each color one of the five luminescent tones to backlight the non-luminescent transmissive halftones. More tones can be chosen, up to the complete luminescent gamut formed by all variations of surface coverages of the chosen set of luminescent emissive inks. In case of UV absorbing non-luminescent halftones superposed with the luminescent tones, the complete luminescent gamut comprises all colors generated by all variations of surface coverages of the luminescent tones, of the UV absorbing non-luminescent halftones and of the color non-luminescent transmissive halftones.

Inside the merged luminescent backlit gamut, all colors can be reproduced by choosing the correct luminescent tone, if applicable, the appropriate surface coverage of the UV absorbing non-luminescent halftones and the appropriate surface coverages of the non-luminescent inks forming the non-luminescent transmissive halftone. The choice of the luminescent tone is constrained by the location of the desired backlit color inside the merged luminescent backlit gamut. If the desired color is located at an intersection of several specific luminescent backlit sub-gamuts, this desired color can be reproduced by any of the corresponding luminescent tones.

Figure 3A:
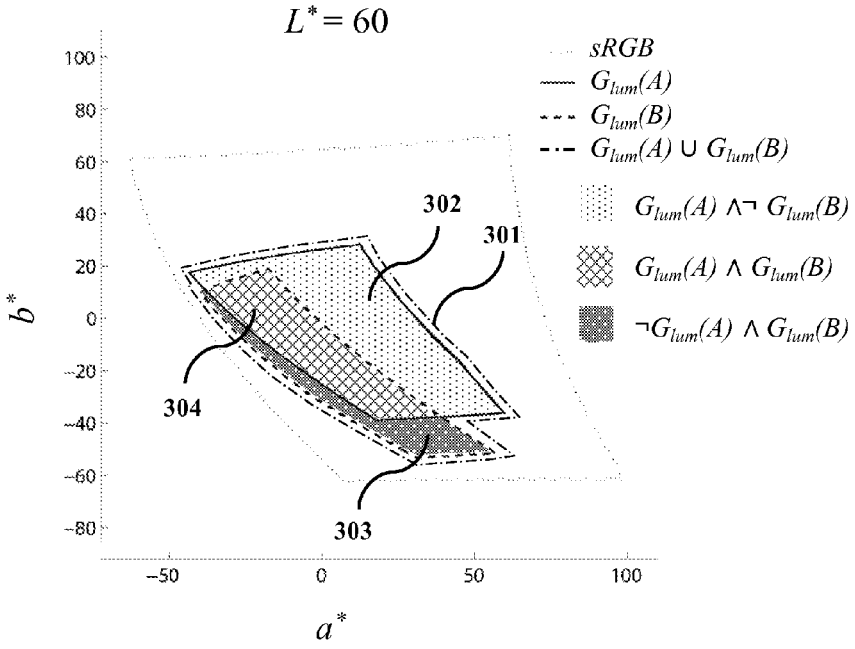
FIG. 3A shows a CIELAB (a*,b*) view at lightness L*=60 of the input sRGB gamut as well as of the luminescent backlit sub-gamuts $G_{lum}(A)$ and $G_{lum}(B)$ formed by the luminescent layer tones A and B respectively attenuated by all possible combinations of halftones of the non-luminescent transmissive ink halftone layer.
Figure 3B:
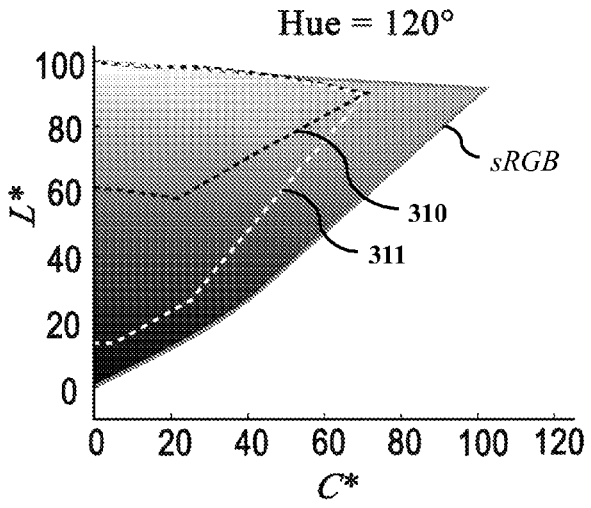
FIG. 3B shows a CIELAB (L*,C*) view at hue angle 120° of the input sRGB gamut as well as of one of the luminescent backlit sub-gamuts, with (311) and without (310) a UV-absorbing non-luminescent halftone layer.

FIG. 3A shows an example where two luminescent tones A and B are available, the merged luminescent backlit gamut (301) $G_{lum}(A) \vee G_{lum}(B)$, is composed of the two specific luminescent backlit sub-gamuts $G_{lum}(A)$ and $G_{lum}(B)$, and of three domains, the intersection domain of the two specific luminescent backlit sub-gamuts (304) $G_{lum}(A) \wedge G_{lum}(B)$, where colors are reproducible with both luminescent tones, the specific luminescent backlit sub-gamut domain associated with the first luminescent tone A where colors are only reproducible with the first luminescent tone (302) $G_{lum}(A) \wedge \neg G_{lum}(B)$, and the specific luminescent backlit sub-gamut domain associated with the second luminescent tone B where colors are only reproducible with the second luminescent tone (303) $G_{lum}(B) \wedge \neg G_{lum}(A)$.

A gamut mapping table is created by providing the input gamut (e.g. the sRGB gamut of standard displays) and a desired output gamut, and by mapping all sampled CIELAB values of the input gamut into the output gamut. At image rendering time, the input color values are gamut mapped by reading the corresponding gamut mapped CIELAB colors from the gamut mapping table, possibly by performing a tri-linear interpolation. Methods for gamut mapping, including gamut translation, adaptation, reduction and extension, are described in Chapter 10, Digital Color Imaging Handbook, (ed. G. Sharma), CRC Press, 2003, p. 639-685, included by reference.

The choice of the output gamut depends on the desired authentication intent. The colors of an image that is intended to be authenticated by transmission under normal light, or reflection under normal light are mapped into the normal light transmitted gamut or normal light reflected gamut respectively. The colors of an image that is intended to be authenticated by luminescent backlighting with a uniform luminescent surface are mapped into the specific luminescent backlit sub-gamut associated with the selected uniform luminescent tone. The colors of an image that is intended to be authenticated by luminescent backlighting with several luminescent tones are mapped into the merged luminescent backlit gamut formed with the selected set of luminescent tones if any of the luminescent tones can be selected at any special location. If there is a particular luminescent tone at a given special location, the colors of the input image are mapped into the intersection of the considered specific luminescent sub-gamuts. The colors of an image that is intended to be authenticated by direct luminescent emission are mapped into the luminescent emission color gamut of the luminescent emissive inks Each of these authentication intents yields a gamut mapping table.

(l) Color Separation and Calculation of the Non-Luminescent Color Ink Surface Coverages After mapping the sRGB gamut into the output gamut selected according to the desired authentication intent, a non-luminescent ink surface coverage separation table is established by associating to each sampled mapped color and for each of the selected luminescent tone and depending on the authentication intent, for normal light, the corresponding surface coverages of the non-luminescent inks. This is carried out by performing, for example, a gradient descent on the corresponding spectral color prediction model, in transmission mode, in reflection mode, or in backlit mode, asking for a given CIELAB color and obtaining the corresponding surface coverages of the non-luminescent inks. In the case that the desired color cannot be achieved by varying the surface coverages of the non-luminescent inks, it is out of the specific luminescent backlit sub-gamut associated with the considered luminescent tone or respectively out of gamut of the colors achievable with the considered normal light source.

The non-luminescent ink surface coverage separation table enables obtaining from an input CIELAB value the optimal surface coverages of the non-luminescent inks separately for each luminescent tone or for normal light. In the case of three non-luminescent inks (e.g. cyan, magenta, yellow), five luminescent tones (e.g. luminescent white, grayish, reddish, greenish and bluish whites), and normal light there are, for each sampled CIELAB color, six entries (one per luminescent tone and one for normal light), containing the surface coverages of cyan, magenta and yellow. Colors that are non-reproducible with the considered luminescent tone or normal light are labeled as non-reproducible. Surface coverages of input CIELAB values located between sampled CIELAB values are obtained by interpolation between surface coverages of the neighboring sampled CIELAB values, e.g. by tri-linear interpolation.

In one embodiment, the authentication intent is an accurate luminescent backlit color image under excitation light. The color backlighting prediction model is composed of the spectral prediction of equation (8) or (9), the conversion of spectra to CIE-XYZ according to equations (11) and the conversion from CIE-XYZ to CIELAB.

In a second embodiment, the authentication intent is an accurate non-luminescent transmissive or reflective image under normal light. The corresponding spectral prediction model is used to build the non-luminescent ink surface coverage separation table usable to create accurate images under normal light, in the selected transmissive or reflective mode.

(m) Color Separation and Calculation of the Non-Luminescent Color Ink Surface Coverages and of the UV-Absorbing Non-Luminescent Ink Surface Coverages The description of section (l) applies also here, but with the non-luminescent ink surface coverage table also containing the surface coverages of the UV absorbing non-luminescent ink halftones printed on top of the luminescent emissive layer. The gradient descent yields the fitted surface coverages of the non-luminescent color inks printed on the recto side and of the UV-absorbing non-luminescent ink halftones printed on the verso side, in superposition with the luminescent emissive layer.

In one embodiment, the authentication intent is an accurate luminescent backlit color image under excitation light. The color backlighting prediction model is composed of the attenuation of the backlight luminescence according to equation (3), the prediction of the backlight attenuation factor by equation (4), of the prediction of the luminescent backlit spectra according to equation (9), of the conversion of spectra to CIE-XYZ according to equation (11) and of the conversion from CIE-XYZ to CIELAB.

In a second embodiment, the authentication intent is an accurate non-luminescent transmissive image under normal light. The corresponding spectral prediction model comprising the attenuation of the incoming normal light by the UV-absorbing non-luminescent ink halftones and by the non-luminescent transmissive ink halftones is used to build the non-luminescent ink surface coverage separation table usable to create accurate images under normal light, in the transmissive mode.

(n) Backlit Color Halftone Image Generation and Printing

Figure 4A:
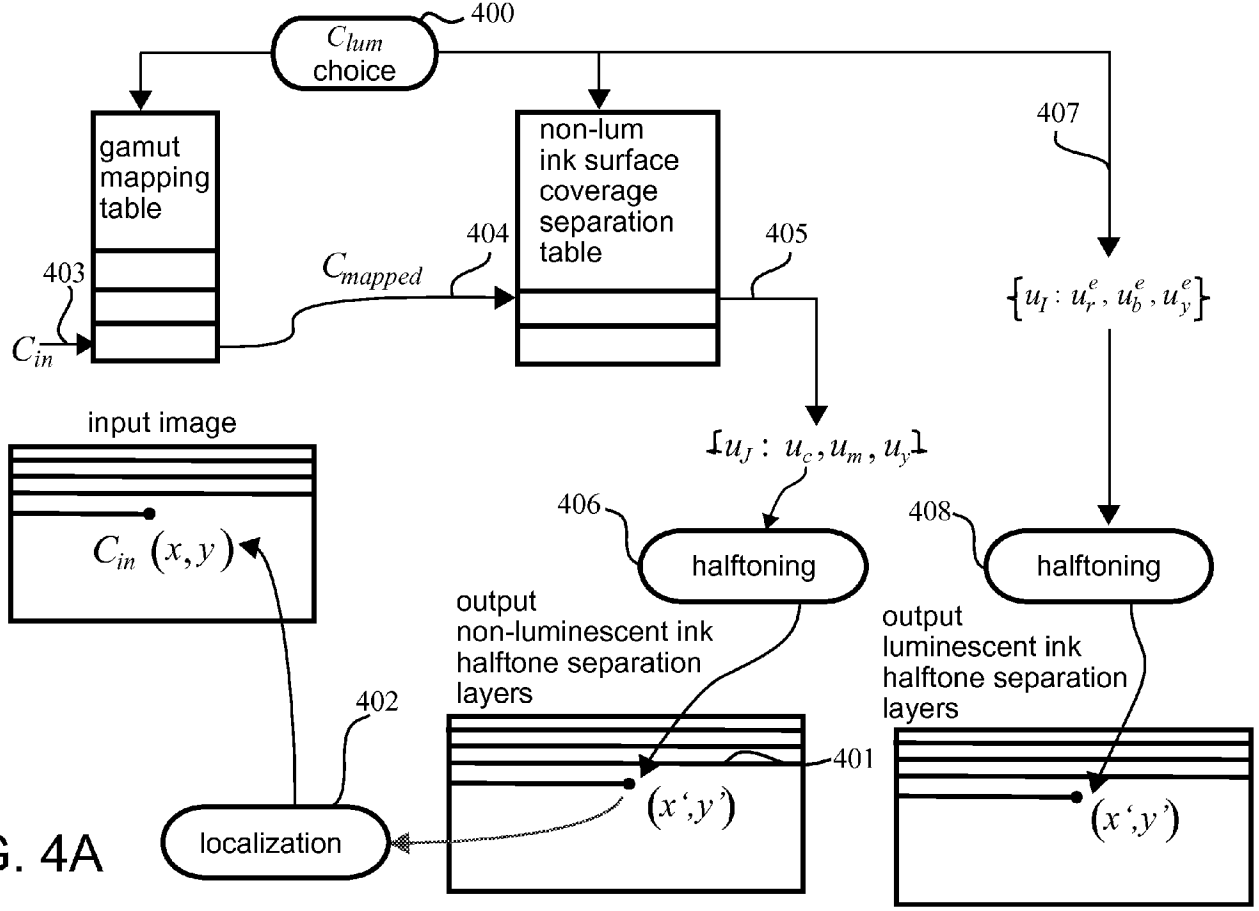
FIG. 4A shows schematically the memory structures for storing data and the processing operations contributing to the creation of backlit color images formed by a luminescent emissive layer incorporating selected emission tones in superposition with a non-luminescent transmissive ink halftone layer.

Backlit color image halftone generation is carried out by creating in a computer memory the separation layers for the non-luminescent transmissive halftone image (1 layer per non-luminescent ink) and if applicable the separation layers for the luminescent emissive halftone image (1 layer per luminescent emissive ink). The separation layers indicate if an ink or no ink is to be printed or how much of each ink is to be printed at each output pixel location. Output image separation layers are created by scanning in computer memory the output image representation, scanline by scanline (FIG. 4A, 401) and pixel by pixel, and for each output pixel (x', y'), performing the following steps: Finding the corresponding input pixel location (x, y) and interpolating (402) the input pixel color from neighbor pixel colors, reading the interpolated color $C_{in}(x,y)$ at that location, mapping the interpolated input color $C_{in}$ into the gamut of the luminescent backlit colors by choosing (400) a luminescent tone $C_{lum}$ in the list of available luminescent tones, accessing (403) the gamut mapping table and reading the mapped color $G_{mapped}(x,y)$ (404), accessing the non-luminescent ink surface coverage separation table and reading (405) the entry associated with the chosen luminescent tone for the desired mapped color $C_{mapped}$, returning (405) the surface coverage of the non-luminescent inks, e.g. $\{u_c, u_m, u_y\}$ associated with a luminescent tone capable of reproducing the desired luminescent backlit color and performing the halftoning (406) of the non-luminescent separation layers according to a selected halftoning method (e.g. classical screening by dithering the ink layers with mutually rotated clustered dot dither matrices or FM screening with a blue-noise dispersed dither matrix), thereby yielding the non-luminescent ink separation halftone layers. The surface coverages of the luminescent emissive inks (407) (e.g. of the red $u_r^e$, blue $u_b^e$ and yellow $u_y^e$ emissive inks) reproducing the available luminescent tones $C_{lum}$ are known in advance and have been memorized. The luminescent separation layers are halftoned (408) according to a selected halftoning method (same algorithm as one of the algorithm mentioned above or juxtaposed halftoning, as described in [Hersch 2007]), and the output luminescent ink halftone separation layers are created.

The halftoning operations (406) and (408) indicate, for each ink layer, if the current pixel is to be set or not, or in case of variable pixel dot sizes, the pixel dot sizes at which the inks are to be printed. Once created, the output separation layers are sent to the printer for printing (printing technologies:

ink-jet, electrophotography, thermal transfer, etc. . . . ) or are used to create the plates for offset printing, the cylinders for gravure or flexo printing or the screen for screen printing. The resulting target luminescent backlit color image is formed by the transmissive color image printed with the selected non-luminescent inks on the recto side, and formed by the selected luminescent tones printed with the luminescent emissive inks on the verso side.

Figure 4B:
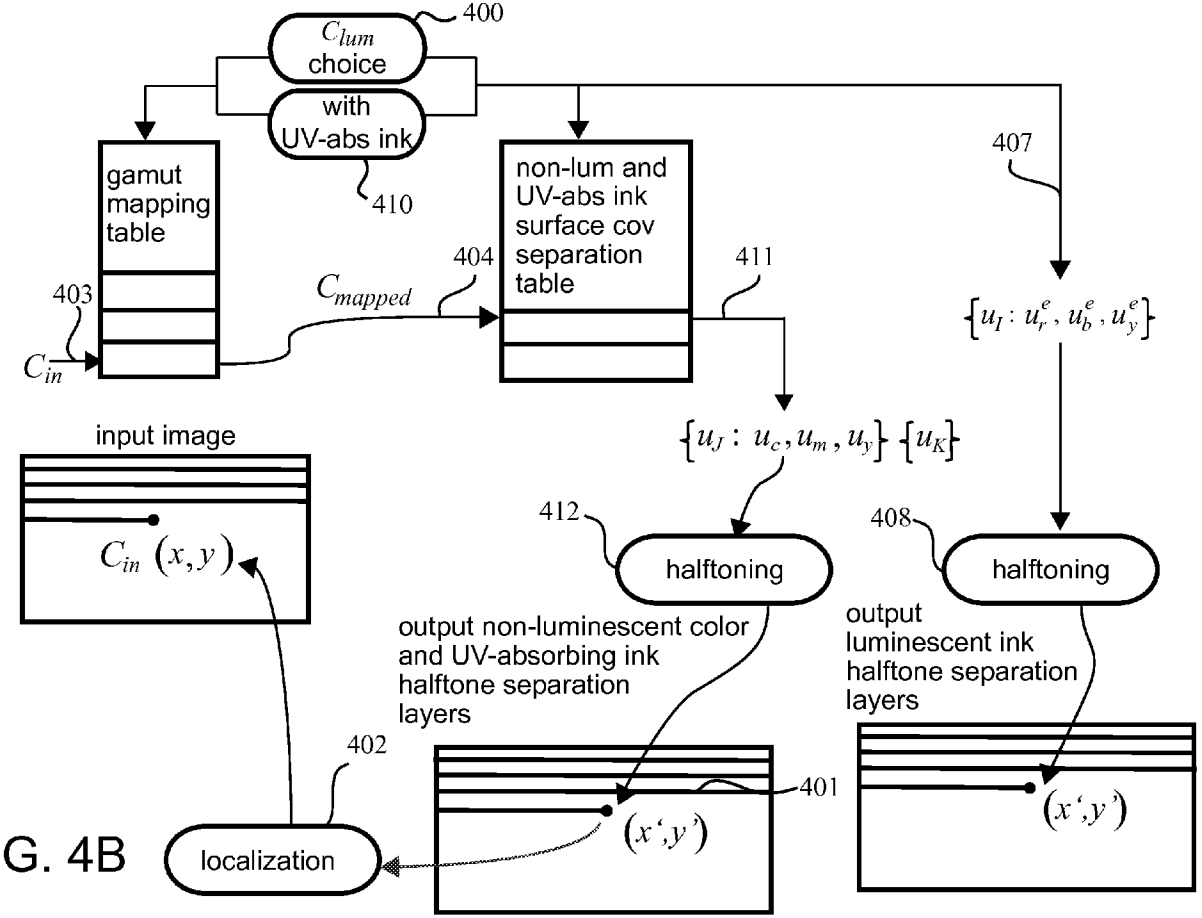
FIG. 4B shows schematically the memory structures for storing data and the processing operations contributing to the creation of backlit color images formed by a luminescent emissive layer incorporating selected emission tones, by a UV-absorbing ink halftone layer and by a non-luminescent transmissive ink halftone layer.

For backlit images produced with a UV-absorbing non-luminescent ink printed on top of the luminescent layer (FIG. 4B), the explanations given in the previous paragraphs apply. However, the target gamut is the gamut formed by variations of the UV absorbing ink halftones, of the luminescent ink halftones and of the non-luminescent color ink halftones. The gamut mapping is therefore different and yields a different gamut mapping table content. The ink surface coverage separation table, now called non-luminescent and UV absorbing ink surface coverage separation table is filled for every gamut mapped color entry by surface coverages of non-luminescent color ink halftones and of UV absorbing non-luminescent ink halftones. Now, in addition to the surface coverages of the non-luminescent inks, e.g. $\{u_c, u_m, u_y\}$, the surface coverages of the UV absorbing non-luminescent ink (411) is also returned, e.g. $\{u_K\}$. Accordingly, halftoning (412) is also performed on the UV absorbing non-luminescent ink layer and an output UV absorbing non-luminescent halftone ink separation layer is produced and printed on the verso side of the security item, superposed with the luminescent emission ink separation halftone layer. The resulting target luminescent backlit color image is formed by the transmissive color image printed with the selected non-luminescent inks on the recto side, by the selected luminescent tones printed with the luminescent emissive inks on the verso side and by the UV-absorbing non-luminescent ink halftones printed in superposition of the luminescent emissive inks on the verso side.

The detailed explanation given in the previous paragraphs apply to halftone image generation for the creation of a backlit luminescent image. For other authentication intents such an accurate image under normal illumination, the gamut mapping table and the non-luminescent ink surface coverage separation table are established for normal light illumination. Halftoning is performed in a similar manner as above.

For the case of Application II, where the transmissive non-luminescent color image A' is an intensity reduced raised instance of an original image A to be viewed under normal light and where the emissive luminescent emissive color image compensates for the intensity reduced raised non-luminescent transmissive color image A' and possibly further incorporates a second independent reduced intensity image C', the transmissive non-luminescent color image is halftoned as described in the previous paragraph. In order to produce a uniform gray backlit luminescent image, the surface coverages of the luminescent emissive color image are calculated at each output image pixel according to Eqs. (15), (16) and (17). In order to produce a second image C' independent of image A', the surface coverages of the luminescent emissive inks are calculated according to Eqs. (15), (16) and (18). With the calculated luminescent emissive ink surface coverages, the luminescent emissive ink separation layers can be halftoned according to the selected halftoning method as mentioned above.

Application I: Creation of Backlit Color Images

By having the possibility of mapping an input gamut into a selected output gamut, see section (k), one may create a luminescent backlit color image that under normal light looks either like an accurately reproduced color image or like a distorted color image, and that, under the excitation illuminant, appears respectively as a distorted luminescent backlit color image or as an accurate luminescent backlit color image depending on the selected authentication intent. For authentication purposes, a luminescent backlit image can be identified and compared with a pre-recorded or printed reference image. Such a luminescent backlit color image has therefore both a protective and a decorative function.

Figure 6A:
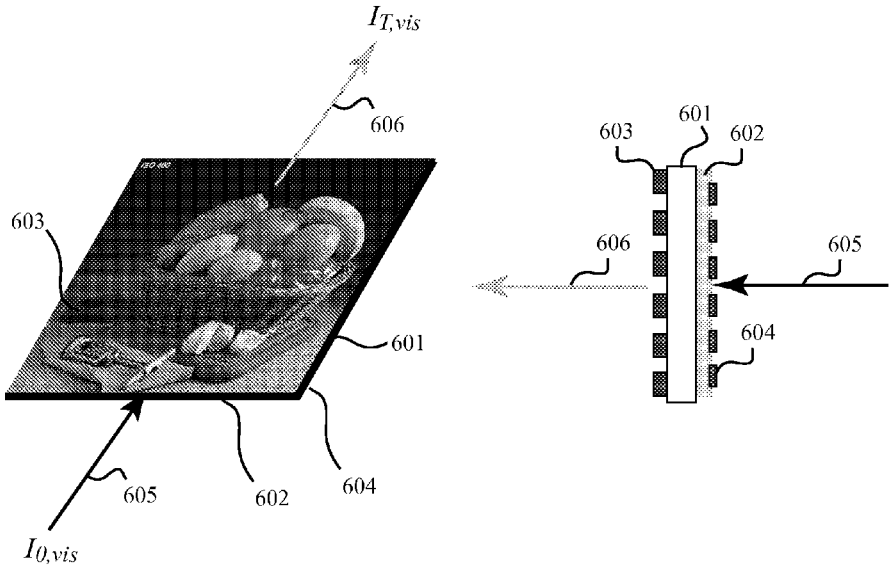
FIG. 6A shows a security device formed by a transmissive layer 601, with a luminescent emissive layer on its verso side 602, a non-luminescent ink halftone layer on its recto side 603, and a UV-absorbing non-luminescent ink halftone layer 604 on top of the luminescent emissive layer on its verso side illuminated by normal white light 605 from the verso side.
Figure 6B:
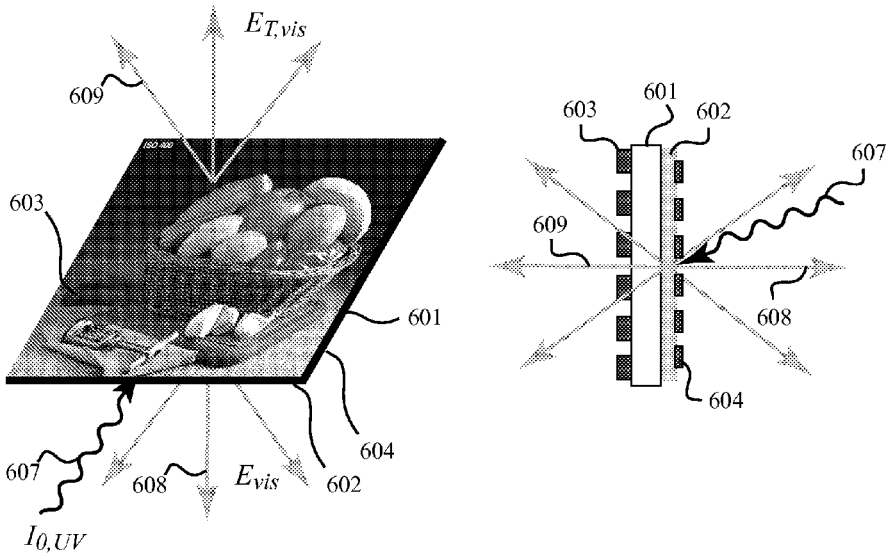
FIG. 6B shows the same security device as in FIG. 6A, but illuminated by an excitation light 607 from the verso side.

In an authentication intent called "accurate luminescent backlit color image under excitation light", the luminescent backlit image has accurate colors, whereas the same image under normal light has distorted colors. The "accurate luminescent backlit color image under excitation light" intent is achieved by mapping the gamut of the input image either into a merged luminescent backlit gamut, into a specific luminescent backlit sub-gamut, or into the intersection of a set of specific luminescent backlit sub-gamuts, depending on the luminescent tone positioning requirements within the luminescent emissive image as explained in section (k). The non-luminescent ink surface coverages are retrieved by reading and interpolating in the non-luminescent ink surface coverage separation table as explained in sections (l) and section (m). The non-luminescent transmissive color halftone image (FIGS. 6A and 6B, 603) is printed on the recto side of a transmissive substrate (601) and a luminescent emissive layer (602) is printed on the verso side. Under normal light illumination $I_{0,vis}$ (605) on the verso side, the normal light backlit image (606) appears with distorted colors. The colors of the normal light backlit image are formed by the normal light illumination $I_{0,vis}$ (605), transmitted through the non-luminescent transmissive color halftone image (603) and possibly through the UV-absorbing non-luminescent ink halftone (604) resulting in the non-luminescent color transmitted irradiance $I_{T,vis}$ (606). Under illumination on the verso side by the appropriate excitation light source (in this example a UV light source, FIG. 6B, 607), the luminescent emissive surface (602) possibly attenuated by the UV-absorbing non-luminescent ink halftone (604) emits light $E_{vis}$ (608) in all directions. The emitted light is transmitted through the non-luminescent color halftones (603) of the image. The transmitted emissions $E_{T,vis}$ (609) at each location of the image then form the colors of the luminescent backlit image that appear accurate to an observer viewing the luminescent backlit image from the recto side. In this embodiment, the authentication is performed by verifying that under an excitation light source, the luminescent backlit image is accurate and is substantially identical with a pre-stored backlit image. For further verification, the distorted non-luminescent transmissive color image can be further compared with a pre-stored distorted non-luminescent transmissive color image. For this authentication intent, a UV absorbing ink halftone layer can be printed on top of the luminescent emissive surface.

In an authentication intent called "accurate non-luminescent backlit color image under normal light", the luminescent backlit image under excitation light has distorted colors, whereas the same image under normal light has accurate colors. The gamut mapping is performed into the respective gamut of the non-luminescent transmissive color image illuminated by the normal light, either in transmission mode or in reflection mode as explained in section (k). The non-luminescent ink surface coverages are retrieved by reading and interpolating in the non-luminescent ink surface coverage separation table as explained in sections (l) and (m). Any invisible luminescent tone can then be printed on the verso side. The color under the excitation light can always be predicted with the backlighting model described in section (i). In this embodiment, the authentication is performed by verifying that under a normal light source, the non-luminescent transmissive color image is accurate and is substantially identical with a pre-stored or printed reference color image. For further verification, the distorted luminescent backlit image can be compared with a pre-stored or printed reference distorted image.

Figure 7:
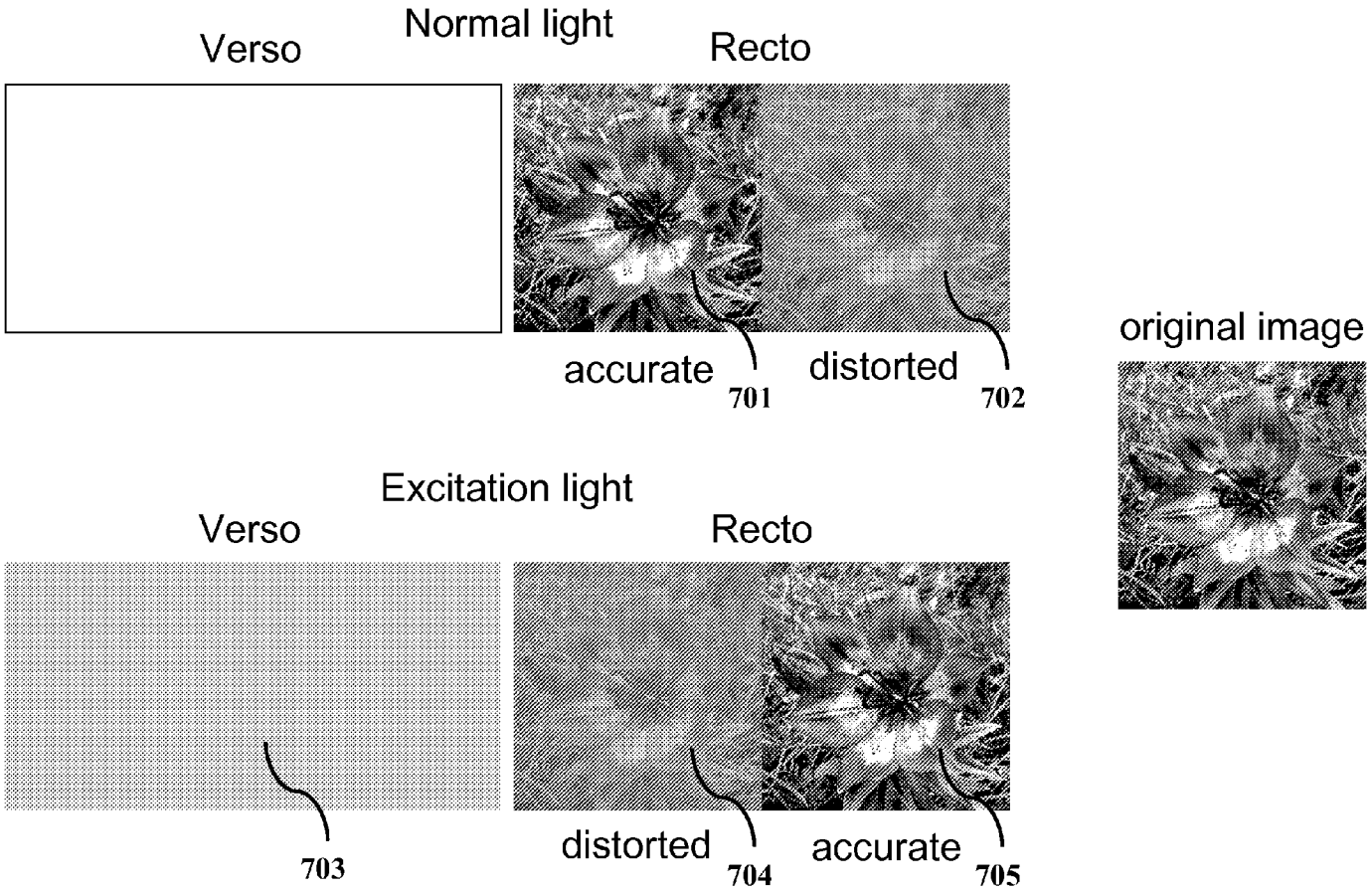
FIG. 7 shows a view of the security device having on its recto side two different non-luminescent ink halftone layers, one generated to be accurate 701 under normal light and distorted under excitation light 704 and the second to be accurate under excitation light 705 and distorted under normal light.

In a further embodiment, one may include the two authentication intents "accurate luminescent backlit color image under excitation light" and "accurate non-luminescent backlit color image under normal light" on a same security element by dividing the luminescent backlit image into parts that have distorted colors under normal light and parts that have accurate colors under normal light. The parts that are distorted under normal light are accurate under the excitation light and the parts that are accurate under normal light are distorted under the excitation light. As an example (FIG. 7), an image is composed of two color picture elements reproduced side by side from the same original picture, one accurate under normal light (701), and the other accurate under excitation light (705). Under the excitation light backlighting (703), the part that was accurate under normal light (701) is distorted (704), and the part that was distorted under normal light is accurate. This is achieved by applying a mask on the image defining the parts that are accurate e.g. under excitation light. Regions outside the masked region are accurate under normal light. For this purpose, the parts where the mask is active, respectively inactive are mapped into the gamut corresponding to the desired authentication intent as described in section (k). Then, the color separation is performed as described in section (l). In this embodiment, the authentication is performed by verifying that under a normal light source, the non-luminescent transmissive color image is accurate and that under the excitation light source, the luminescent backlit image is accurate.

In the case of the two authentication intents mentioned above, it is possible to use a UV absorbing non-luminescent ink halftone layer for attenuating the spectral emission from the luminescent emissive layer and for attenuating the amount of transmitted normal light. As a result, the non-luminescent transmissive color ink halftones printed on the recto side and viewed in reflection mode exhibit mainly chromatic differences. The lightness differences present in the corresponding backlit image when viewed in transmission mode are mainly due to the UV absorbing non-luminescent ink halftone layer printed on the verso side.

Application II: Authentication by Two Independent Accurately Reproduced Images

The present invention enables the authentication of documents and valuable items by enabling viewing quasi-simultaneously at the same spatial location two different independent images that are accurately reproduced. One image A' is formed by the printed non-luminescent color inks on the recto side viewed either in transmission or in reflection mode under normal light and a second image C' is viewed in transmissive mode, under excitation light, e.g. UV light.

Figure 5:
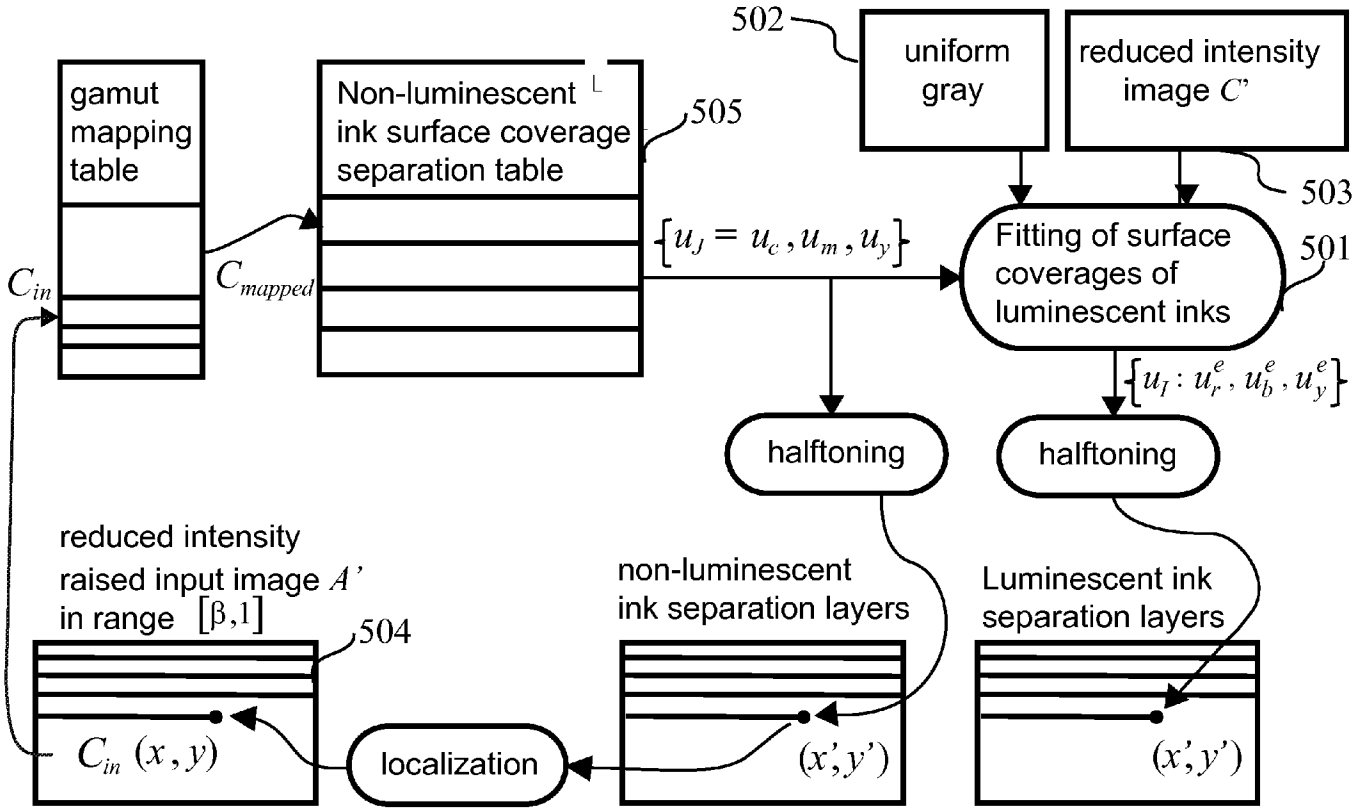
FIG. 5 shows schematically the memory structures for storing data and the processing operations contributing to the creation of backlit color images formed by a non-luminescent transmissive ink halftone layer and a luminescent emissive ink halftone layer with fitted luminescent emissive ink surface coverages.

The emission image B printed on the verso side with invisible luminescent emissive inks is conceived so as (a) to reduce intensities at all locations of the luminescent backlit image to a common lowest intensity level by reducing the corresponding emissions of image B and (b) to create luminescent backlit image C by further attenuating the emissions of image B. The novel approach aiming at compensating for the attenuation of a first non-luminescent transmissive image by emission of its negative image and aiming at incorporating a second independent image by further attenuation of the luminescent emission relies on the fact that the dark parts of a transmissive non-luminescent image do not necessarily need to fully attenuate the incoming light. From an original color image, it is easy to create a reduced intensity range image whose darkest parts attenuate only a fraction of the incident light, e.g. down to 47% of the maximal intensity. For example, a non-luminescent transmissive or reflective reduced intensity range image A' can be formed by reducing the intensities $\{d_A: r_A, g_A, b_A\}$ of the original RGB image into a limited intensity range between a lowest intensity β and the maximal intensity (FIG. 5, 504). In case of intensities ranging between 0 and 1, the intensity reduced raised image is obtained by applying on each channel of the linear RGB or of the corresponding CIE-XYZ image the operation:

$$d_A'=(1-\beta)\cdot d_A+\beta \tag{12}$$

Figure 8A:
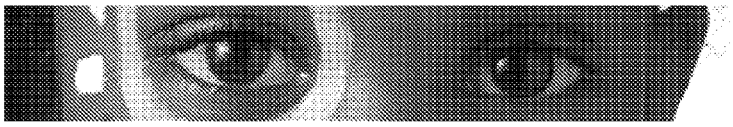
FIG. 8A shows an original image A.
Figure 8B:
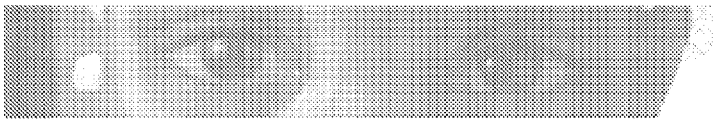
FIG. 8B shows an intensity reduced raised non-luminescent transmissive image A' deduced from original image A.
Figure 8C:
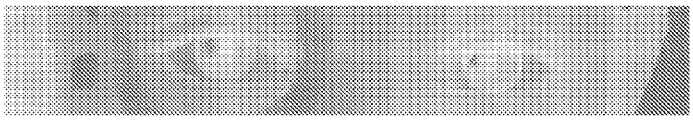
FIG. 8C shows a luminescent layer emission halftone image A" compensating for the intensity reduced raised non-luminescent transmissive image A'.
Figure 8D:
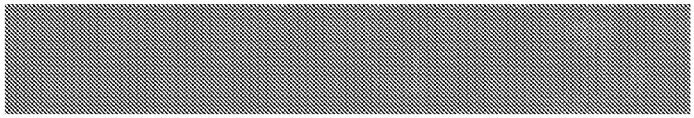
FIG. 8D shows the backlit luminescent uniform gray image resulting from the superposition of layer images A' and A" under excitation light.

As a first example, FIG. 8A shows an original image A from which an intensity reduced raised non-luminescent transmissive image A' is generated (FIG. 8B). Here, the intensity reduced raised non-luminescent image A' covers the intensity levels between β=120/255 and 255/255. FIG. 8C shows a luminescent layer emission halftone image compensating for image A' and creating a uniform gray backlit image (FIG. 8D) of intensity level β. This compensating luminescent layer emission halftone image is clearly a negative of the reduced intensity raised non-luminescent image A'. The presence of both the spatially uniform gray backlit image under excitation light and of the original intensity reduced raised non-luminescent transmissive color image under normal light (FIG. 8B) can serve as authentication feature.

Figure 9A:
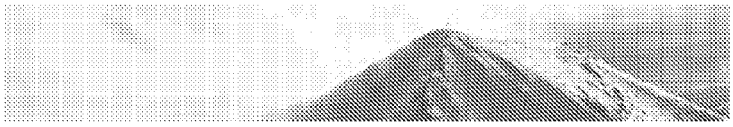
FIG. 9A shows an original image C whose scaled down intensity instance further attenuates image A" of FIG. 8C, resulting in FIG. 9B, so as to obtain as superposition image under excitation light as backlit luminescent image the scaled down intensity instance of image C, shown in FIG. 9C.
Figure 9B:
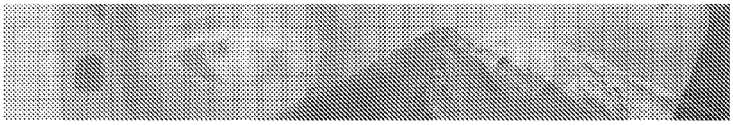
Figure 9C:
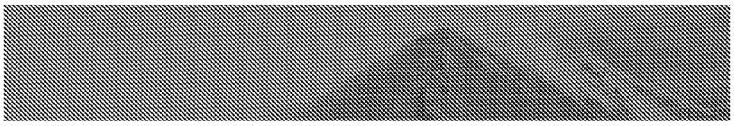

As a second example, the aim is to have the same original intensity reduced raised non-luminescent transmissive color image A' under normal light (FIG. 8B) and to create an independent reduced intensity image C' under excitation light (FIG. 9C). Reduced intensity image C' is deduced from a given original image C (FIG. 9A) by applying to it simple intensity downscaling (FIG. 5, 503), i.e. for example an original image in the range 0 (black) to 1 (white) is scaled down to 0 to β (e.g. β=0.4). This can be carried out on each channel of a linear RGB or CIE-XYZ color image. The resulting luminescent layer emission halftone image B (FIG. 9B) compensates for the reduced raised transmissive image A' and provides additional attenuation in order to create the backlit luminescent reduced intensity image C' shown in FIG. 9C. This emission halftone image B (FIG. 9B) incorporates both a negative of the reduced intensity raised non-luminescent transmissive image A' and a further attenuation being a function the desired backlit luminescent reduced intensity image C'. The presence of both the original intensity reduced raised non-luminescent transmissive color image under normal light and of the reduced intensity image C' under excitation light serves as authentication feature.

In a transmissive mode embodiment, the reduced intensity range raised non-luminescent transmissive image A' is accurately reproduced by mapping the input gamut (e.g. sRGB gamut) into the "normal light transmitted gamut" formed by the normal light illuminant attenuated by the non-luminescent transmissive color image. Surface coverages $u_J$ of the non-luminescent inks are obtained according to section (l) "Color separation and calculation of the non-luminescent ink surface coverages". These surface coverages (FIG. 5, 505) are then used to color halftone and print the non-luminescent transmissive image A' according to Section (n).

In a reflective mode embodiment, the reduced intensity range non-luminescent reflective image A' is accurately reproduced by mapping the input gamut (e.g. sRGB gamut) into the "normal light reflected gamut".

In the transmissive mode, the transmittances $T_{nl}(\lambda)$ of the non-luminescent transmissive image are given by Eqs. (5)

and shown in Eq. (13) as a function of the surface coverages $u_J$ of the non-luminescent inks $$T_{nl}(u_J, T_j) = \left(\sum_j D_j(u_J) \cdot T_j(\lambda)^{\frac{1}{m}}\right)^m \tag{13}$$

where $D_j(u_J)$ are the Demichel functions yielding the surface coverages $a_j$ of the colorants as a function of the surface coverages $u_J$ of the inks and where $T_j(\lambda)$ are the transmittances of the non-luminescent colorants printed on the substrate, on its recto side.

With a normal light illuminant $I_0$ illuminating the non-luminescent transmissive image, the corresponding colors are obtained by their CIE-XYZ tri-stimulus values as shown in Eqs. (11), where $S(\lambda)=I_0\ T_{nl}(\lambda)$. For the CIE $X_{nl}$, $Y_{nl}$, $Z_{nl}$ values of non-luminescent color halftones viewed in transmissive mode, printed with ink surface coverages $u_J$ we obtain $$\begin{aligned} X_{nl} &= K_{nl} \cdot \int_\lambda I_0 \cdot T_{nl}(u_J, T_j) \cdot \bar{x}(\lambda) \cdot d\lambda \\ Y_{nl} &= K_{nl} \cdot \int_\lambda I_0 \cdot T_{nl}(u_J, T_j) \cdot \bar{y}(\lambda) \cdot d\lambda \\ Z_{nl} &= K_{nl} \cdot \int_\lambda I_0 \cdot T_{nl}(u_J, T_j) \cdot \bar{z}(\lambda) \cdot d\lambda \end{aligned} \tag{14}$$

with $$K_{nl} = \frac{100}{\int_\lambda I_0 \cdot T_w(\lambda) \cdot \bar{y}(\lambda) \cdot d\lambda},$$

where $T_w(\lambda)$ is the transmittance of the unprinted transmissive substrate.

The luminescent backlit image spectra $E_{Tlum}(\lambda)$ under an appropriate excitation light such as UV light is formed by the emission spectrum $E(\lambda)$ multiplied by the transmittance spectrum of the non-luminescent halftone at the corresponding location, as given by Eq. (10), embodied here by Eq. (15), where $u_I$ and $u_J$ are respectively the surface coverages of the luminescent emissive inks printed on the verso side and of the non-luminescent inks printed on the recto side.

$$E_{Tlum}(a_i, a_j, E_i, T_j) = \left(\sum_i D_i(u_I) \cdot E_i(\lambda)^{\frac{1}{n}}\right)^n \cdot \left(\sum_j D_j(u_J) \cdot T_j(\lambda)^{\frac{1}{m}}\right)^m \tag{15}$$

Equation (15) represents a joint emissive-transmissive model predicting the backlit luminescent emission spectra or colors obtained by luminescent emissive ink halftones irradiating under excitation light non-luminescent light absorbing ink halftones.

Eq. (16) gives the corresponding CIE $X_{lum}$, $Y_{lum}$, $Z_{lum}$ tri-stimulus values of the colours seen on the recto side when the verso side with the luminescent emissive halftone is illuminated with the excitation light source (UV light):

$$X_{lum} = K_{lum} \cdot \int_\lambda E_{Tlum}(u_I, u_J, E_i, T_j) \cdot \bar{x}(\lambda) \cdot d\lambda \tag{16}$$

-continued $$Y_{lum} = K_{lum} \cdot \int_\lambda E_{Tlum}(u_I, u_J, E_i, T_j) \cdot \bar{y}(\lambda) \cdot d\lambda$$

$$Z_{lum} = K_{lum} \cdot \int_\lambda E_{Tlum}(u_I, u_J, E_i, T_j) \cdot \bar{z}(\lambda) \cdot d\lambda$$

$$K_{lum} = \frac{100}{\int_\lambda \left(\sum_i \left(D_i(u_{Iw}) \cdot E_i(\lambda)^{1/n}\right)\right)^n \cdot T_w(\lambda) \cdot \bar{y}(\lambda) \cdot d\lambda}$$

where $u_{Iw}$ are the surface coverages of the luminescent emissive inks that yield together with the substrate transmittance $T_w(\lambda)$ the reference white transmissive color.

Compensating under UV light for the non-luminescent transmissive image A' can be performed by creating a gray surface $Y_{lumGray}$ at the lowest $Y_{lum}$, intensity value induced by the surface coverages $u_{Iw}$ of the luminescent emissive inks yielding the reference white attenuated by the darkest ink halftone present in the non-luminescent transmissive halftone image A'. This uniform gray surface can be obtained by fitting at each pixel location according to Eqs. (16) the surface coverages of the luminescent emissive inks $u_J$ creating the gray intensity given by $Y_{lumGray}$ (FIG. 5, 502) and by enforcing the $x_{lum}$, and $y_{lum}$ CIE chromaticies to become $x_{lum} \cong 1/3$ and $y_{lum} \cong 1/3$. With the set of Eqs. (17) and with Eqs. (16) an executable software function can fit the luminescent emissive ink surface coverages $u_I$ (see FIG. 5, 501)

$$\begin{aligned} &Y_{lum} = Y_{lumGray} \\ &x_{lum}(a_i) = X_{lum}/(X_{lum}+Y_{lum}+Y_{lum}) \cong 1/3 \\ &y_{lum}(a_i) = Y_{lum}/(X_{lum}+Y_{lum}+Y_{lum}) \cong 1/3 \end{aligned} \tag{17}$$

This is performed by an optimization procedure minimizing e.g. the sum of square differences between the desired chromaticities and the predicted chromaticities (in the Matlab software package: functions "fminsearch" or "fmincon").

Creating a reduced intensity range backlit image C' completely independent of the reduced intensity range image A' uses the intensity range $Y_{lum}$, between 0 and $Y_{lumGray}$. Therefore the CIE $X_c$, $Y_c$, and $Z_c$ colorimetric values of original image C, obtained by converting from sRGB to CIE-XYZ need to be scaled by a factor $\gamma$ to fit within the intensity range 0 to $Y_{lumGray}$. A possible value is $\gamma = Y_{lumGray}/Y_{cMax}$, where $Y_{cMax}$ is the largest intensity value present in image C. An alternative consists in assuming that the highest intensity present in an image is $Y_{cMax}=100$; in that case, $\gamma = Y_{lumGray}/100$. A reduced intensity range image C' is computed (FIG. 5, 503) whose CIE-XYZ values are $X_c' = \gamma X_c$; $Y_c' = \gamma Y_c$; and $Z_c' = \gamma Z_c$. Then, for each pixel within the luminescent emissive color image, the surface coverages $u_I$ of the luminescent emissive inks are fitted (FIG. 5, 501) by equating Eqs. (16) with the CIE-XYZ values of the reduced intensity raised image C'

$$\begin{aligned} &X_{lum} = Y_c'; \\ &Y_{lum} = Y_c'; \\ &Z_{lum} = Z_c', \end{aligned} \tag{18}$$

by starting e.g. a gradient descent with the previously computed surface coverages $u_J$ of the non-luminescent inks present at that location. The resulting luminescent emission color halftone image B to be printed on the verso side of the transmissive substrate is then composed of the negative of image A' and of the positive of image C'.

The joint calculation of the surface coverages $u_J$ of the non-luminescent inks and of the surface coverages $u_I$ of the luminescent emissive inks is very difficult to achieve without the mathematical framework presented above and provides therefore a valuable protection against counterfeits. In addition, in order to show under excitation light (UV light) backlit luminescent image C' and be able to hide the non-luminescent transmissive image A' printed in perfect superposition on the recto side, there is a need for a high registration accuracy between the printed luminescent emissive color image B on the verso side and the printed non-luminescent color image A' on the recto side. Such a high registration accuracy can only be achieved in high end printing systems, mainly systems for printing security documents.

Application III: Embedding Messages Hidden Upon Luminescent Backlighting

Since different luminescent tones can yield the same luminescent backlit color once filtered through the non-luminescent transmissive halftones, a message can be hidden on the recto side upon luminescent backlighting from the excited verso side, but be visible on the verso side as a direct luminescent message. The authentication is then performed by verifying that the message appearing on the verso side is completely hidden on the recto side, when illuminated with an excitation light source (UV light).

Figure 10A:
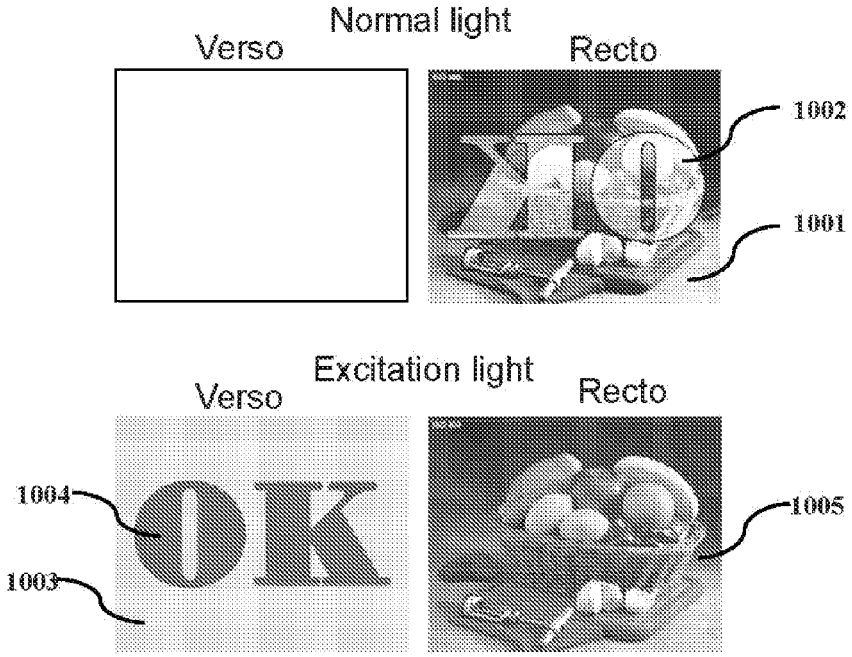
FIG. 10A shows an example of a superposition of a non-luminescent transmissive ink halftone image incorporating a message with foreground colors 1002 and background colors 1001 and of a luminescent ink halftone with the same message with foreground luminescent tone 1004 and background luminescent tone 1003, said superposition yielding under excitation light a backlit luminescent image 1005 where said message does not appear.

As an example, a direct luminescent message "OK" appearing under excitation light can be formed with a luminescent surface (FIG. 10A, 1004) printed with a defined foreground luminescent tone on the verso side. The luminescent layer background is defined with a different luminescent tone (1003). The difference in luminescent emission between the two different luminescent tones enables to visualize the direct luminescent message from the verso side. In order to hide the message in the luminescent backlit image appearing on the recto side, the non-luminescent transmissive image is composed of two regions (1001) and (1002) located at the same positions as the luminescent message foreground and luminescent background on the verso side. Illuminated by normal light, the non-luminescent transmissive image shows a non-luminescent message formed by the two different regions (1001) and (1002). Nevertheless, under excitation light, the luminescent backlit image (1005) on the recto side appears substantially the same as the original image thus hiding the direct luminescent message (1004).

The luminescent tones are chosen so as to create a well visible direct luminescent color difference and so as to minimize the luminescent backlit color differences between the desired luminescent backlit colors (i.e. the gamut mapped colors of the input color image) and the reproduced luminescent backlit colors. Since the two luminescent tones should be able to reproduce all luminescent backlit colors, the gamut mapping maps the colors of the input image into the intersection of the two specific luminescent sub-gamuts associated with the two selected luminescent tones.

The non-luminescent transmissive image is printed on the recto side of the transmissive substrate with the surface coverages of the non-luminescent inks associated with the luminescent tone used to print the luminescent message foreground (1002), and with the surface coverages of the non-luminescent inks associated with the luminescent tone used to print the luminescent background (1001). The luminescent tones of the luminescent message foreground (1004) and luminescent background (1003) are halftoned on the verso side of the transmissive substrate with the corresponding respective surface coverages of the luminescent inks The detailed procedure is described in section (m).

Figure 10B:
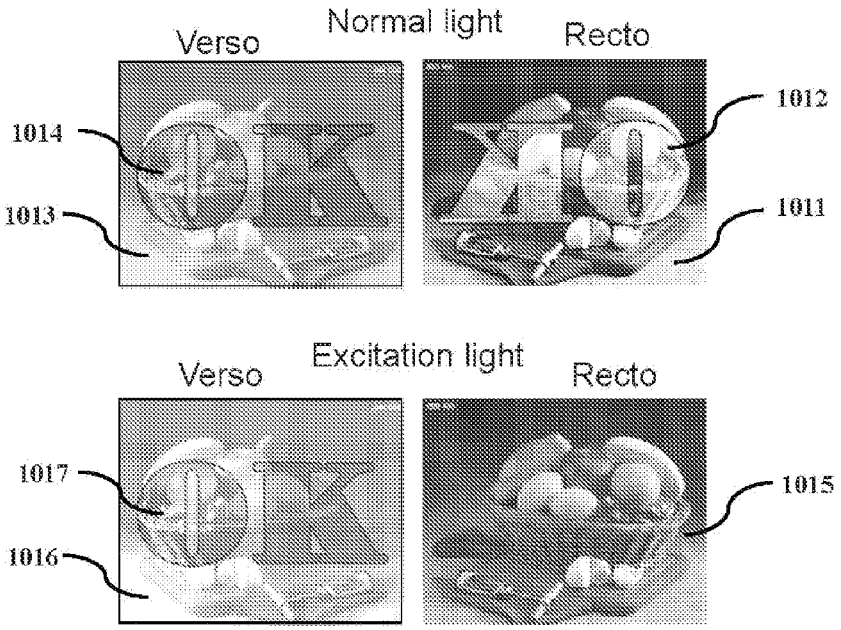
FIG. 10B shows a superposition of layers similar to the one of FIG. 10A, with in addition a UV-absorbing non-luminescent ink halftone layer printed on the verso side on top of the luminescent ink halftone, also incorporating the same message with foreground intensity 1014 different from background intensity 1013, and where under excitation light, the superposition of the three messages cancel each other in the resulting luminescent image 1015.

Let us consider a similar embodiment with a single luminescent tone for both the background 1003 and the foreground 1004 where the luminescent backlit images are produced using UV-absorbing ink halftones on the verso side. In the example shown in FIG. 10B, a message appearing on the verso side under normal light and under the excitation light is formed by a region (FIG. 10B, 1014) printed with a dark highly attenuating UV-absorbing non-luminescent ink halftone in the foreground and by a lighter less attenuating UV-absorbing non-luminescent ink halftone (1013) in the background. The message is hidden in the luminescent backlit image (1015) appearing on the recto side under the excitation light. Under normal light, the color image shown on the recto side incorporates at the same location as on the verso side, the message background (1011) and foreground (1012) regions printed with the appropriate non-luminescent color ink surface coverages. The combination of the UV-absorbing attenuated luminescence from region 1014 with the non-luminescent less attenuating color halftones in region 1012 gives the same colors in region 1015 as the UV-absorbing attenuated luminescence from region 1013 with the non-luminescent color halftone in region 1011. Ink surface coverages are computed according to the procedures described in section (m) and by using two different non-luminescent and UV-absorbing ink separation tables, with two differently constrained UV-absorbing non-luminescent ink surface coverages fitted according to the selected luminescent tone.

Application IV: Embedding Invisible Messages into a Luminescent Backlit Image

Figure 11:
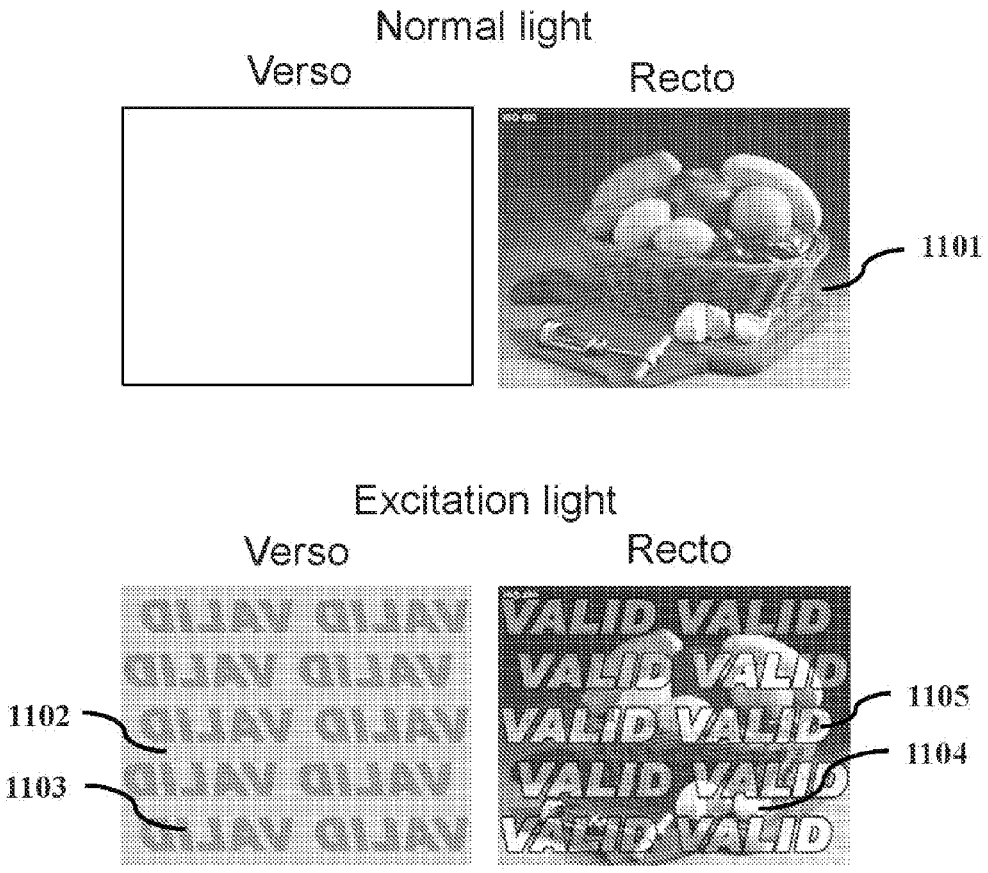
FIG. 11 shows an example of a non-luminescent transmissive ink halftone 1101 reproducing accurately an original image under normal light from the verso side, a luminescent emissive layer incorporating a message whose foreground 1103 is of a first emissive color and whose background 1102 is of a second emissive color, and the resulting backlit luminescent image appearing on the recto side under excitation light, said backlit luminescent image being formed by an instance of the original image embedding the message with foreground colors 1105 different from the background colors 1106.

Luminescent invisible red, yellow-green and blue inks or a white emissive layer can create a luminescent emissive layer visible under the excitation light (e.g. UV light), but invisible under normal light. A message (FIG. 11, 1103) incorporated onto the luminescent emissive layer on the verso side is invisible under normal light.

Under the excitation light, the luminescent emissive layer illuminates the non-luminescent transmissive color image. If the luminescent emissive layer has two different luminescent tones for the message foreground (1103) and background (1102), the luminescent backlit image will display the message present in the luminescent emissive layer.

Figure 12:
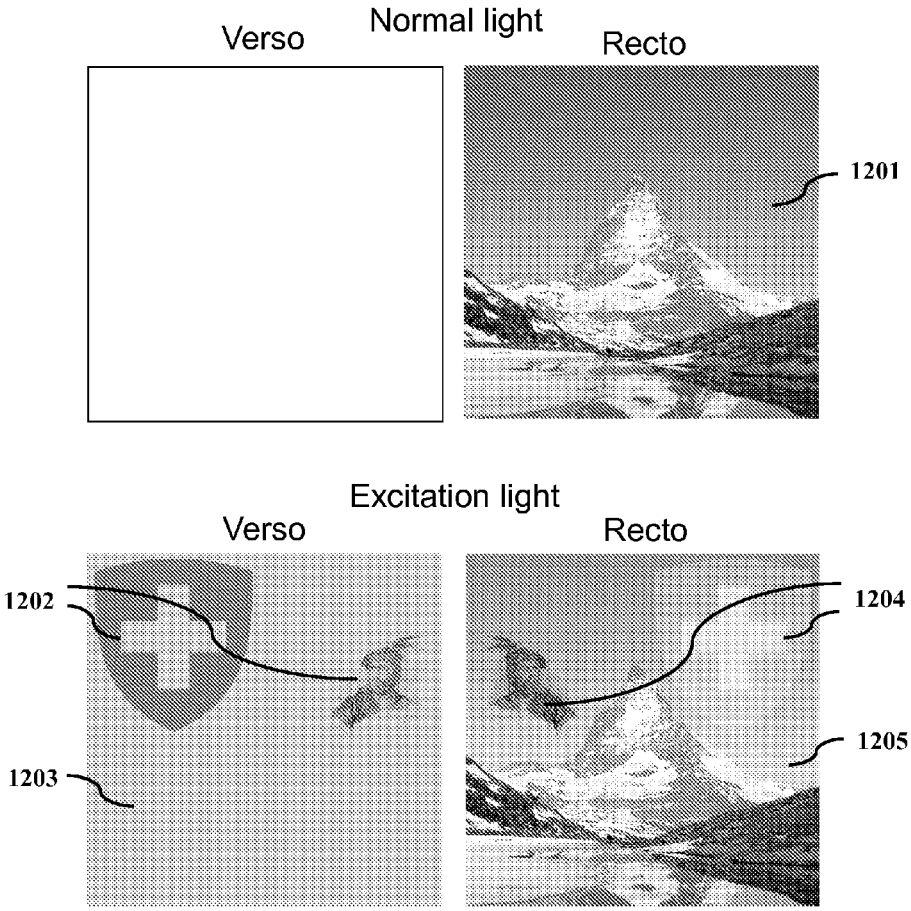
FIG. 12 shows an example working in a similar manner as the example of FIG. 11, where instead of a message, the luminescent emissive layer incorporates a mark such as the swiss national emblem 1202 as well as a drawing of a personality and where the corresponding backlit luminescent image incorporates the mark and the drawing of the personality 1204 embedded within an instance of the original image.

Furthermore, different messages formed by different luminescent tones can be revealed. In addition, the luminescent backlit message can be a variable intensity or variable color mark (1202) that is visible only under the excitation light source (FIG. 12).

The image is reproduced to appear accurately under normal light. This is achieved by mapping the colors of the input image (e.g. the photograph of the document holder) into the normal light transmitted gamut as described in section (k). Under an excitation light source, the authenticity of a document or valuable item is verified by observing if its luminescent backlit image, e.g. the backlit photograph of the document holder, incorporates the expected message, for example the name and birth date of the document holder.

As in previous applications, the non-luminescent ink surface coverages are obtained from the non-luminescent ink surface coverage separation table according to the desired authentication intent.

Generalizations of the Present Invention

Besides being printed, the non-luminescent color halftone image, the luminescent emissive layer and the UV-absorbing non-luminescent halftone image can be created by other imaging means such as gratings creating light diffraction patterns, holography, thin films creating interference colors, multilayer structures, light emitting devices, luminescent materials emitting light in the visible wavelength range. Corresponding production processes may rely on lithography, photolithography, electronic beam erasure, ion deposition, engraving, etching, perforating, and embossing, see R. L. Van Renesse, Chapter 7, Interference-based security features, in Optical Document Security, 3rd edition, Artech House, pp 223-264, included by reference.

Figure 13:
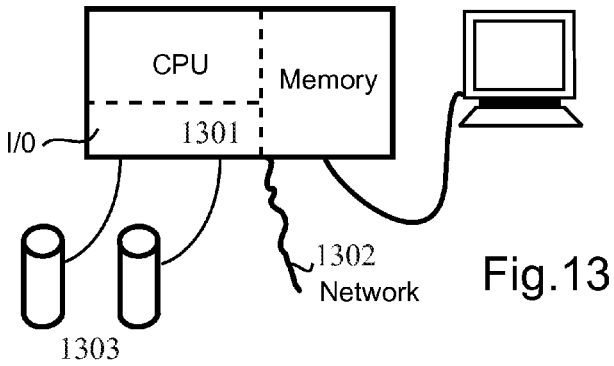
FIG. 13 shows a computing system for creating luminescent color halftone images comprising a CPU, memory, I/O interfaces, disks, a display, a keyboard and a network connection.
Figure 14:
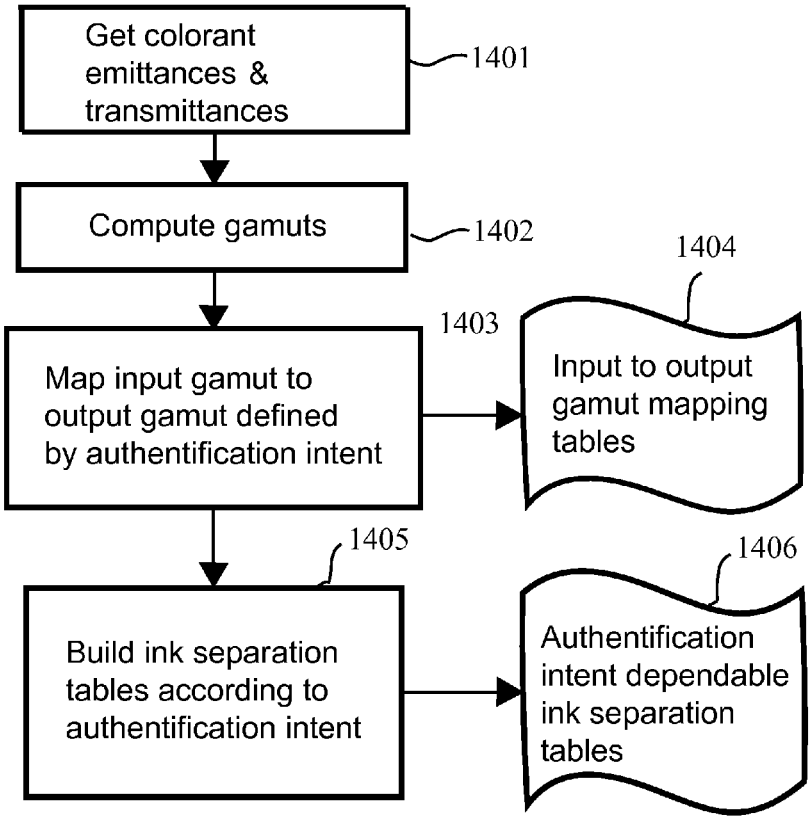
FIG. 14 describes the initialization steps performed when launching the computing system creating the luminescent and non-luminescent layers for backlit color halftone images.
Figure 15:
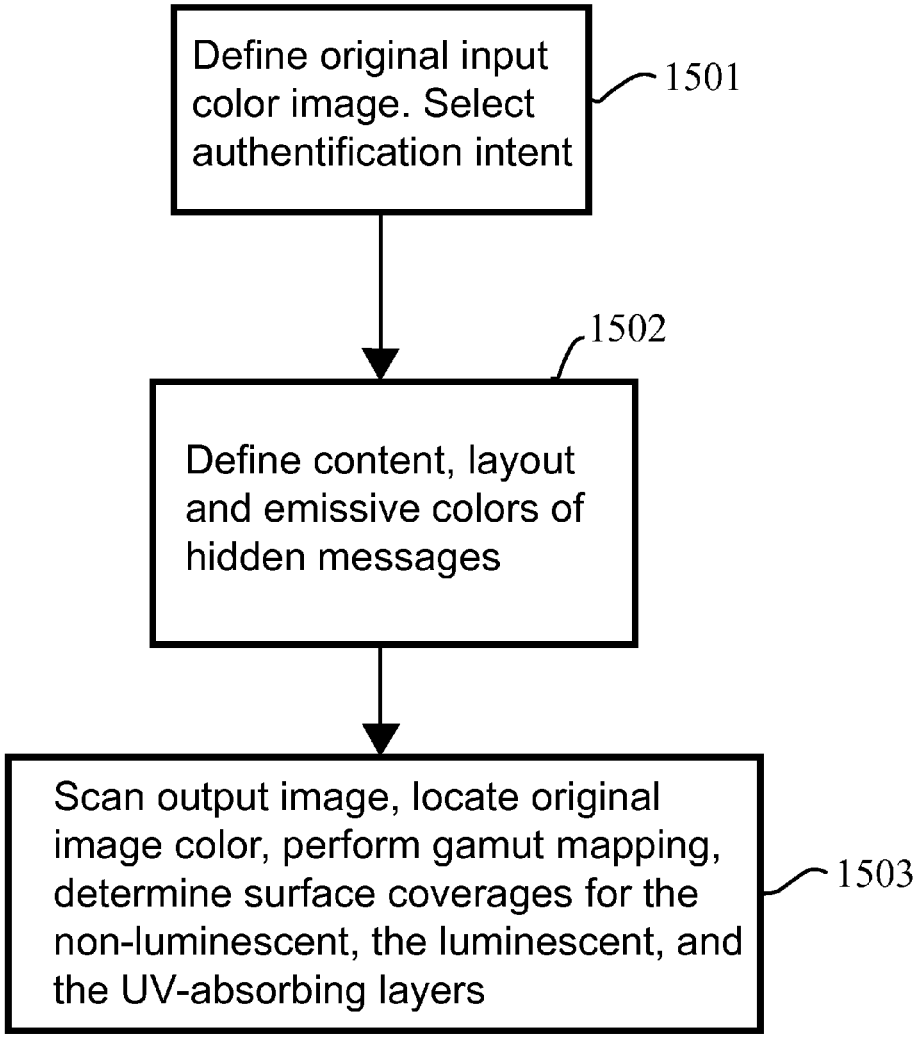
FIG. 15 shows the steps performed in order to create the luminescent and non-luminescent layers for backlit color halftone images incorporating hiding a message under one type of light and showing it under another type of light.

Computer-based implementation of the methods for creating luminescent backlit color halftone images relying on luminescent emissive halftones illuminating across a transmissive substrate non-luminescent transmissive color halftones A software package running on a computing system (FIG. 13: CPU, memory, input/output 1301, communication means 1302, storage means such as disks 1303) allows creating in memory or on disks daylight luminescent color halftone images. Let us first describe the initialization steps (FIG. 14) performed when launching the system. The luminescent backlit color halftone image rendering system is initialized by performing the steps of measuring the reflectances 1401 of the contributing classical and luminescent emissive inks as well as their superpositions (colorants). With the help of a color or spectral prediction model, a relationship is established between surface coverages of the inks and predicted spectrum or color. By predicting a large number of colors thanks to many combinations of surface coverages of the selected subset of inks (e.g. each ink at nominal surface coverages of 0, 0.05, 0.1, 0.15, 0.2, . . . 0.9, 0.95, 1), a data set comprising many colors is formed and its gamut given by its external hull is determined 1402, see [Cholewo and Love 1999]. In a further step, according to the authentication intent, a selected input gamut, e.g. the display gamut, or the input image gamut can be mapped into a given output target gamut 1403. The input gamut can also be mapped into the intersection of several luminescent sub-gamuts. This operation results in gamut mapping tables 1404 mapping the input gamut colors into output gamut colors according to the desired authentication intent. A last initialization step consists in building 1405, thanks to the spectral or color prediction model, the ink separation table indicating for each color within a grid of the selected color space (e.g. CIELAB) the amounts of inks, or in terms of nominal surface coverages, the surface coverages of the selected non-luminescent inks allowing to print that backlit luminescent color. Once the system is initialized, actual backlit luminescent color images can be synthesized by the software and sent to the printer (FIG. 15). This may be carried out by the following steps. An automatic or an operator driven procedure enables defining the authentication intent and the original input color image 1501 to be reproduced according to the selected authentication intent, e.g. as non-luminescent transmissive image under normal light as well as the content, layout and emissive colors of the hidden message 1502. The target output color image is generated by determining at each output location the corresponding original input image color, by performing the gamut mapping into the target output gamut according to the selected authentication intent through access of the gamut mapping table, and by determining the surface coverages of the non-luminescent color inks and if applicable the luminescent inks and the UV-absorbing non-luminescent inks for respectively the non-luminescent color layer, the luminescent layer and the UV-absorbing non-luminescent layer to be printed at the current output image location, see 1503. These surface coverages are halftoned and the ink separation halftone layers are sent to the printer, used to create the offset plates for offset printing or the cylinders for gravure or flexo printing.

Computing System for Synthesizing Luminescent Backlit Color Halftone Images

Figure 16:
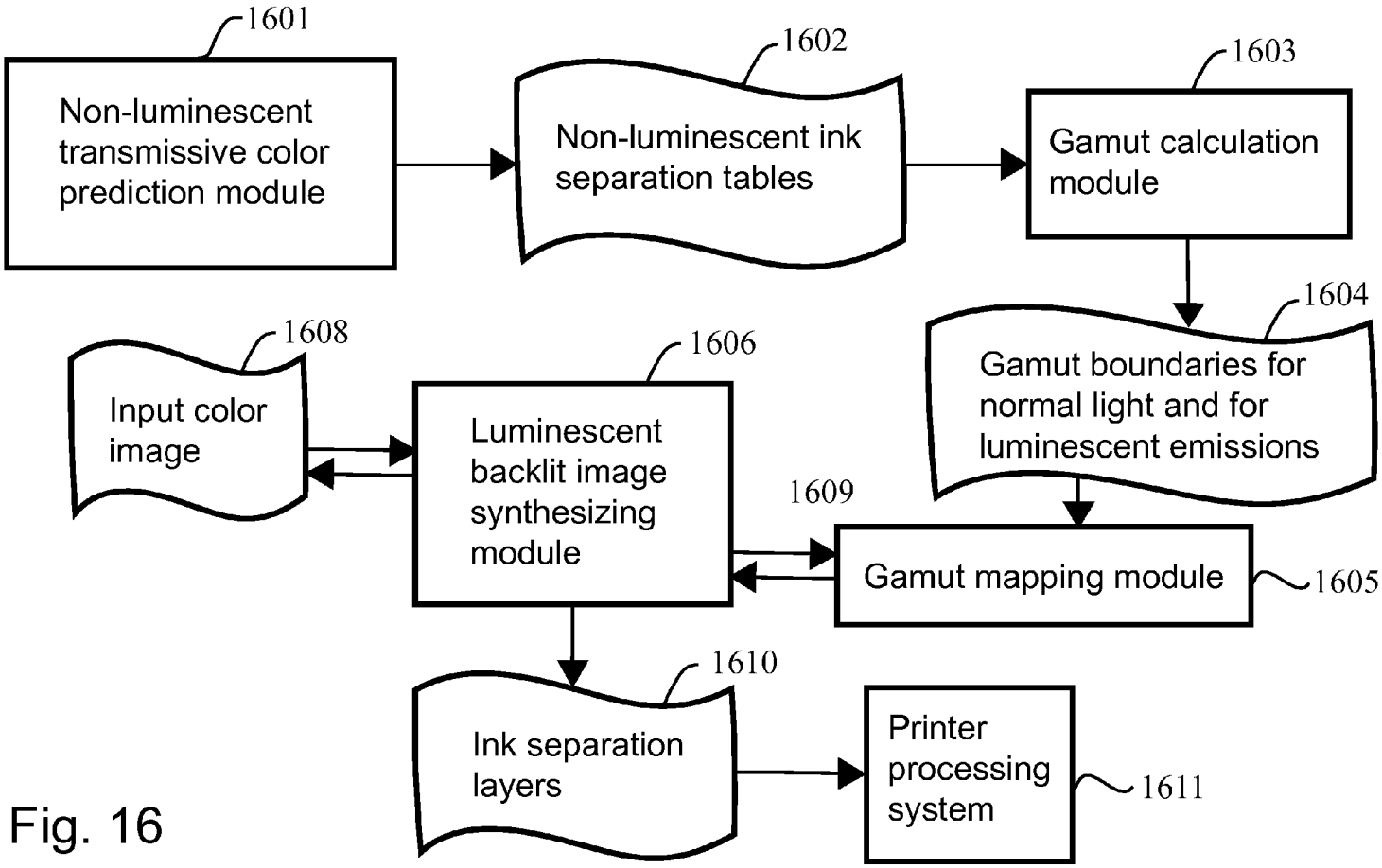
FIG. 16 shows the interacting software modules of a computing system operable for synthesizing the luminescent and non-luminescent layers for backlit color halftone images.

A computing system for synthesizing luminescent backlit color halftone images comprises a number of software modules, simply called "modules". At system initialization time, a transmissive color (or spectral) prediction module (FIG. 16, 1601) establishes the relationship between surface coverages and resulting colors of the non-luminescent transmissive inks illuminated either by normal light or by the emissions of the luminescent emissive layer and creates a corresponding ink separation table 1602. A gamut calculation module 1603 computes the boundaries 1604 of the gamuts of the contributing luminescent emissions by relying on the colors predicted by the transmissive color prediction module. A gamut mapping module 1605 performs gamut mapping of the input gamut onto the output gamut defined the selected authentication intent, e.g. for transmission under normal light the "normal light transmissive gamut", for reflection under reflection under normal light the "normal light reflective gamut", for accurate luminescent backlit color image under excitation light a specific luminescent backlit sub-gamut, or the intersection of specific luminescent sub-gamuts, each sub-gamut being associated with a specific luminescent tone. At output image synthesizing time, a luminescent backlit image synthesizing module 1606 scans the locations of the output image, locates the corresponding locations within the original input color image 1608, gets these original colors, calls 1609 the gamut mapping module in order to map the input gamut colors into the non-luminescent gamut colors, determines the surface coverages of the non-luminescent inks forming the non-luminescent layer, of the luminescent emissive ink(s) and if applicable of the UV-absorbing non-luminescent ink(s), performs the halftoning and sends the resulting ink separation layers 1610 for further processing to a printer processing system 1611, i.e. either directly to the printer, or to the imaging device responsible for producing the supports required for printing (offset plates for offset, cylinders for gravure printing or flexo, screens for screen printing, etc.).

Authenticating a Valuable Item by a Human being or by an Apparatus

The authentication of a valuable item can be carried out by a human being, for example the person verifying the identity of the passengers embarking on an airplane or the customer buying a valuable item such as a watch. In this case the person verifying the valuable item's backlit halftone color image will first observe it under normal light $I_0$ and then under excitation light. Depending on the authentication intent, the person will verify that the non-luminescent backlit color image is accurate under normal light or that the luminescent backlit color image is accurate under excitation light and if a message is embedded, that the corresponding message is revealed.

The authentication of the valuable item incorporating a verso side with the luminescent emissive halftone layer and a recto side with the non-luminescent layer halftone image may also be carried out by an apparatus, which projects either a normal or an excitation light source onto the valuable item's verso side and acquires with an acquisition device (e.g. camera, smartphone, multi-channel sensor array) the backlit image appearing on the recto side.

This apparatus then compares the extracted backlit image with a previously registered reference image and according to matching techniques known in the art, decides if the extracted backlit image matches the previously registered reference image or not. If a match is found, the valuable item is labeled as authentic.

Figure 17:
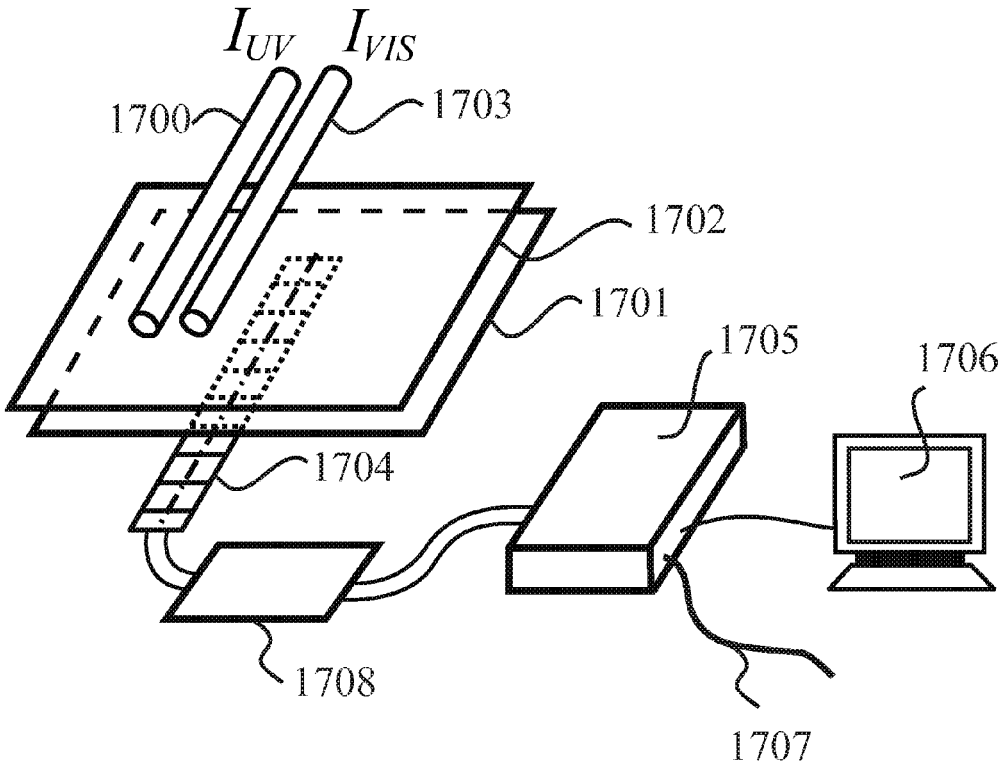
FIG. 17 shows an example of a computer-based authenticating apparatus working in transmission mode.

An example of such a computer-based authenticating apparatus is given in FIG. 17. This apparatus is appropriate for authenticating transmissive documents by transmittance measurements. It comprises the normal white light source 1703 and the excitation light source active in the UV wavelength range 1700, the luminescent emissive layer 1702, the non-luminescent transmissive color image 1701 on the part of the valuable item to be authentified, the multi-channel sensor array 1704 and its electronics 1708 as well as a computing system 1705 storing in its memory the images acquired by the multi-channel sensor array. The computing system may also incorporate a display indicating if the valuable item being scanned is authentic or not. In addition, as an option the computing system may be connected to the Internet 1707 in order to validate that the acquired images from the scanned valuable item are valid.

Let us give an example of how such an apparatus works. The apparatus scans the part of the valuable item 1701 to be authenticated by displacing it in respect to the light sources and multi-channel sensor array. There is a scan of the valuable item under the normal white light and a scan of the valuable item under the excitation light. The scan performed with the normal white light generates the backlit non-luminescent output image visible under normal light and the scan performed with the excitation light generates the backlit luminescent output image. Both images are scanned multi-channel images, for example with blue (wavelength range 400 nm-500 nm), green (wavelength range 500 nm-570 nm), red (wavelength range 570 nm-730 nm) channels. For the authentication of the valuable item, each of the acquired multi-channel images are compared with a corresponding previously registered reference image by applying image matching techniques.

Advantages of the Present Invention

The fact that the backlit images are formed by superposed luminescent emissive and non-luminescent absorbing layers enables creating secure devices which are very difficult to counterfeit, since a potential counterfeiter would have to correctly reproduce all the layers, whose individual intensities or colors are unknown to him.

Both the luminescent emissive halftone layer possibly incorporating a UV-absorbing non-luminescent ink halftone and the non-luminescent color halftone layer are synthesized by using, according to the desired authentication intent, a color prediction model able to infer, by an optimization procedure such as gradient descent, ink surface coverages as a function of the desired colors of the resulting backlit luminescent or non-luminescent variable intensity or color image. Without the software implementing the color prediction model and able to predict ink surface coverages, it is not possible to counterfeit faithfully both the luminescent emissive and the non-luminescent halftone layers.

A further advantage resides in the fact that a message embedded within the luminescent layer on the verso side and hidden by compensation in the non-luminescent layer located on the recto side, appears as authenticable backlit image without message under excitation light and with the message under normal white light. On the other side, a message embedded within the non-luminescent layer and hidden by compensation within the luminescent layer and/or possibly by the UV-absorbing non-luminescent ink halftone appears as authenticable backlit image without message under excitation light and as backlit image with the message under normal white light. The authentication of either of these two cases is easily performed by any person with the help of both a normal white light source and of an excitation light source illuminating the secure item from its verso side. The simultaneous presence and absence of the message when switching the type of light source clearly indicates that the valuable item incorporating the security device is authentic.

The invention claimed is:

1. A computer-based method for producing an authenticable security device as part of a valuable item, said security device comprising at least one luminescent emissive layer composed of luminescent emissive material and one non-luminescent layer composed of non-luminescent light absorbing ink halftones, authenticable by observing a backlit color image under normal white light and under excitation light, the method comprising the steps of (a) selecting an authentication intent from the set of (i) accurate luminescent backlit color image under excitation light, (ii) accurate non-luminescent backlit color image under normal white light, (iii) jointly accurate non-luminescent backlit color image under normal white light and accurate backlit luminescent color image under excitation light;

(b) performing a gamut mapping between an input color space and a color space deduced from the selected authentication intent;

(c) establishing according to the selected authentication intent a non-luminescent ink surface coverage separation table associating to colors mapped according to said gamut mapping corresponding surface coverages of the non-luminescent inks;

(d) by relying on said non-luminescent ink surface coverage separation table, separating by computation an input image with colors mapped according to said gamut mapping into surface coverages of non-luminescent inks;

e) halftoning and printing said surface coverages of non-luminescent inks, thereby forming said non-luminescent layer;

where said luminescent emissive layer is superposed with said non-luminescent layer, with a separating transmissive layer between them.

2. The method of claim 1, where said separating transmissive layer is a layer made of a material selected from the set of paper and plastic.

3. The method of claim 1, where an additional UV absorbing non-luminescent ink halftone layer is placed on top of said luminescent emissive layer, thereby locally adjusting its emission intensity and where said non-luminescent ink surface coverage separation table also comprises surface coverages of the UV absorbing non-luminescent ink halftones.

4. The method of claim 1, where said luminescent emissive material emits light at variable intensity and is formed by an element selected from the set of variable luminescent emissive ink halftones, variable luminescent emissive ink pixel dot sizes, variable emissive material concentration, and variable emissive material thickness.

5. The method of claim 4, where in case that said authentication intent is an accurate luminescent backlit color image under excitation light, a backlighting model for predicting the luminescent backlit colors is used for establishing said non-luminescent ink surface coverage separation table;

where in case that said authentication intent is an accurate non-luminescent backlit color image under normal light, a transmittance prediction model for predicting the transmitted colors of the non-luminescent transmissive image is used for establishing said non-luminescent ink surface coverage separation table;

and where in case that said authentication intent is a jointly accurate non-luminescent backlit color image under normal white light and accurate backlit luminescent color image under excitation light, a joint emissive-transmissive prediction model predicting the color stimuli resulting from the luminescent emissive ink halftones transmitted through the non-luminescent transmissive image is used for calculating the surface coverages of the luminescent emissive ink halftones.

6. The method of claim 5, where the backlighting model for predicting the backlit color stimuli resulting from emission spectra transmitted through the non-luminescent transmissive image relies on luminescent backlit spectra predicted by multiplying the spectra emitted by surface coverages of the luminescent ink halftones with the surface coverage dependent transmittances of the light absorbing non-luminescent ink halftones.

7. The method of claim 6, where the equation yielding the luminescent backlit spectra $E_T$ as a function of surface coverages $u_I$ of the luminescent emissive ink halftones and of the surface coverages $u_J$ of the non-luminescent ink halftones is $$E_T(a_i, a_j, E_i, T_j) = \left(\sum_i D_i(u_I) \cdot E_i(\lambda)^{\frac{1}{n}}\right)^n \cdot \left(\sum_j D_j(u_J) \cdot T_j(\lambda)^{\frac{1}{m}}\right)^m$$

where $D_i(u_I)$ and respectively $D_j(u_J)$ are Demichel functions yielding surface coverages $a_i$ of luminescent colorants and $a_j$ of non-luminescent colorants as a function of the surface coverages $u_I$ and $u_J$ of their respective luminescent and non-luminescent inks, where $T_j(\lambda)$ are the transmittances of the non-luminescent colorants printed on the substrate, where $E_i(\lambda)$ are emission spectra of the luminescent colorants and where n and m are scalar values optimized on a set of calibration samples.

8. The method of claim 5, where the authenticable security device comprises side by side the accurate luminescent backlit color image under excitation light and the accurate non-luminescent backlit color image under normal light, and where the authentication is performed by verifying that said luminescent backlit color image viewed under excitation light is substantially similar to the non-luminescent backlit color image viewed under normal light.

9. The method of claim 5 where the authentication intent is the jointly accurate non-luminescent backlit color image under normal white light and the accurate backlit luminescent color image under excitation light in registration and where the authentication is performed by verifying that said accurate luminescent backlit color image viewed under excitation light is substantially similar to a first reference color image and that said accurate non-luminescent backlit color image viewed under normal white light is substantially similar to a second reference color image.

10. The method of claim 9 where the accurate non-luminescent backlit color image is an intensity reduced raised image whose dynamic range is within a reduced range of intensities and where the luminescent emissive ink halftones compensate for the intensity variations of the intensity reduced raised non-luminescent color image and provide further attenuation in order to yield said accurate backlit luminescent color image under excitation light.

11. The method of claim 1, where said security device is reproduced with an additional authentication intent consisting of an accurate non-luminescent backlit color image under normal white light and of substantially the same color image superposed with a luminescent backlit message under excitation light, said backlit message being created by at least two different emissive colors of the luminescent emission layer for respectively the foreground and the background of said backlit message.

12. The method of claim 3 where the emission spectrum intensity $E(\lambda)$ is the emission intensity $E_0(\lambda)$ of the luminescent emissive ink halftones attenuated by a factor $K(\lambda)$ deduced from effective surface coverages of the halftones present in said UV absorbing non-luminescent ink halftone layer.

13. The method of 12, where said UV absorbing non-luminescent ink halftone layer is formed by ink halftones selected from the group of black, cyan, magenta yellow and custom ink halftones, and where the attenuation factor $K(\lambda)$ is calculated by an attenuation prediction model relying on ink halftone surface coverages.

14. A computer system for synthesizing an authenticable security device comprising at least one luminescent emissive layer composed of luminescent emissive material and one non-luminescent layer composed of non-luminescent light absorbing ink halftones, authenticable under normal white light and under excitation light, said computer system comprising a transmissive color prediction module establishing a relationship between surface coverages and resulting colors of non-luminescent inks illuminated by the luminescent emissive layer, a gamut calculation module computing the boundaries of gamuts by relying on the colors predicted by the transmissive color prediction module, a gamut mapping module mapping an input gamut into an output gamut selected from the set of normal white light transmitted gamut, normal white light reflected gamut, luminescent backlit sub-gamut, intersection of luminescent backlit sub-gamuts, and merged luminescent backlit gamut, and a backlit output image synthesizing module, where said backlit output image synthesizing module scans locations of the backlit output image, locates corresponding locations within an original input color image, gets their original colors, calls the gamut mapping module to map the input gamut into an output gamut defined by an authentication intent, determines surface coverages of the non-luminescent light absorbing ink halftones, performs halftoning and sends resulting non-luminescent halftones to a printer processing system, and where said security device is authenticated by comparing the backlit output images under normal white light and under excitation light with their respective pre-stored reference images.

15. The computer system of claim 14, where said luminescent emissive material of variable intensity is created with an element selected from the set of variable luminescent ink halftone surface coverages, variable luminescent ink pixel dot sizes, variable emissive material concentration, and variable emissive material thickness.

16. The computer system of claim 14, where the printer processing system is selected from the group of printing system and imaging device, said printing system being operable for creating halftone ink layers on a substrate from said ink separation layers with a technology selected from the set of inkjet, electrophotography, dye diffusion, thermal transfer, photolithography, etching, coating, laser marking, laser engraving, and laser ablation technologies and said imaging device being operable for producing print supports selected from the set of offset plates for offset printing, plates for flexographic printing, cylinders for gravure printing, screens for serigraphy, and photomasks for photolithography.

17. A computer-based apparatus for authenticating a valuable item comprising a security device produced according to claim 1 embedded within a valuable item, said computer-based apparatus comprising a normal white light source and an excitation light source illuminating the security device, a multi-sensor acquisition device acquiring from the same spatial location of said security device a sampled luminescent image under excitation light and a sampled non-luminescent image under normal white light and further comprising a computing system operable for comparing the acquired sampled images with previously registered reference sampled images and accordingly deciding if the security device is authentic.

18. The apparatus of claim 17, where the valuable item is an item selected from the set of banknotes, checks, trust papers, identification cards, passports, travel documents, tickets, diploma, business documents, bank documents, tracing documents, medical drug packages, commercial art, fashion articles, watches, clocks, bottles of perfumes, body care liquids, alcoholic drinks, clothes, attached labels.

19. The apparatus of claim 17 working in transmissive mode, where the light sources are placed on the verso side of the security device, where the multi-sensor acquisition device is placed on the recto side of the security device.

20. A valuable item incorporating a security device produced according to claim 1, said security device comprising on the verso side a luminescent emissive layer and on the recto side a non-luminescent color ink halftone layer.

21. The security device of claim 20 whose luminescent emissive layer embeds a message and whose non-luminescent color ink halftone layer embeds a negative instance of said message, thereby preventing the message emitted from the luminescent emissive layer under excitation light from the verso side to become visible within the backlit luminescent image observed from the recto side of said security device.

22. The security device of claim 20, where the non-luminescent color ink halftone layer embeds in addition to the negative instance of the message an intensity scaled down original image, which becomes visible as backlit luminescent image under excitation light when observed from the recto side of said security device.

23. The security device of claim 20, where the luminescent emissive layer embeds a message, where the non-luminescent color ink halftone layer is halftoned so as to produce under normal white light an accurate non-luminescent backlit color image and where under excitation light, the corresponding luminescent backlit color image shows said message.

24. The security device of claim 20, where an additional UV absorbing non-luminescent ink halftone layer is placed on top of said luminescent emissive layer, said UV absorbing non-luminescent ink halftone layer forming an image which is a derived instance of the observed backlit color image.

25. The valuable item of claim 20, said item being selected from the set of banknotes, checks, trust papers, identification cards, passports, travel documents, tickets, diploma, business documents, bank documents, tracing documents, medical drug packages, commercial art, fashion articles, watches, clocks, bottles of perfumes, body care liquids, alcoholic drinks, clothes, attached labels.

* * * * *